US005954528A

United States Patent [19]

Ono et al.

[11] Patent Number: 5,954,528

[45] Date of Patent: Sep. 21, 1999

[54] CONNECTOR CONNECTION STRUCTURE

[75] Inventors: Junichi Ono; Kensaku Takata; Hiroyuki Hayashi, all of Nagoya, Japan

[73] Assignees: Harness System Technologies Research, Ltd., Nagoya; Sumitomo Wiring Systems, Ltd., Yokkaichi; Sumitomo Electric Industries, Ltd., Osaka, all of Japan

[21] Appl. No.: 08/827,728

[22] Filed: Apr. 8, 1997

Related U.S. Application Data

[63] Continuation-in-part of application No. 08/719,073, Sep. 24, 1996.

[30] Foreign Application Priority Data

| | | | |
|---|---|---|---|
| Feb. 27, 1996 | [JP] | Japan | 8-040078 |
| Apr. 30, 1996 | [JP] | Japan | 8-109467 |
| Nov. 20, 1996 | [JP] | Japan | 8-309625 |

[51] Int. Cl.[6] ..... H01R 13/62

[52] U.S. Cl. ..... 439/157; 439/152; 439/153; 439/310

[58] Field of Search ..... 439/152, 153, 439/154, 155, 156, 157, 310, 372

[56] References Cited

U.S. PATENT DOCUMENTS

| | | | |
|---|---|---|---|
| 5,279,506 | 1/1994 | Kawase et al. | 439/157 |
| 5,484,297 | 1/1996 | Takahashi et al. | 439/157 |
| 5,611,703 | 3/1997 | Okamoto et al. | 439/157 |
| 5,628,642 | 5/1997 | Bieringer et al. | 439/157 |
| 5,658,162 | 8/1997 | Harting et al. | 439/157 |

FOREIGN PATENT DOCUMENTS 3-126379 U 12/1991 Japan .

*Primary Examiner*—Paula Bradley
*Assistant Examiner*—Katrina Davis
*Attorney, Agent, or Firm*—Oliff & Berridge, PLC

[57] ABSTRACT

A connector connection structure includes a first connector supported on a holder and a second connector connectable to the first connector. The holder has support portions in the form of U-shaped grooves, for supporting the first connector such that the first connector is slidable in a direction of connection of the first and second connectors relative to each other. Swingable levers are swingably supported between the holder and the first connector, and there are provided drive portions that swingingly displace the swingable levers in response to the sliding movement of the first connector. Operating portions are also provided to increase driving forces of the swingable levers, and transmit the driving forces to the second connector, thereby driving the two connectors in a direction to connect the two connectors together.

16 Claims, 19 Drawing Sheets

CONNECTOR CONNECTION STRUCTURE

This is a Continuation-in-Part of application No. Ser. 08/719,073, filed Sep. 24, 1996.

BACKGROUND OF THE INVENTION

The present invention relates to a connector connection structure for electrically connecting first and second mating connectors together.

To enhance the connectability of a multi-pole connector having many terminals that present a large connecting resistance, there has been proposed a structure, for example, in Japanese Utility Model Unexamined Publication No. 3-126379. The proposed connector structure includes an operating member having a manipulation portion operable by the operator, and a cam plate for driving a pair of connectors in a direction to connect them together. The manipulation portion amplifies a driving force inputted thereto and converts the driving force into a connecting force for connecting the two connectors together. Thus, the two connectors are connected together using this particular operating member.

In the above connector connection structure, the driving force of the manipulation portion driven by the operator is amplified by the operating member, and is converted into the connecting force for connecting the two connectors together. There is an advantage that even in a multi-pole connector, which exhibits a large connecting resistance, the pair of connectors can be positively connected together. However, after housings of the two connectors are provisionally engaged with each other, the two connectors must be shifted into a completely-connected condition by driving the manipulation portion of the operating member, thus requiring a two-stage operation. Consequently, there is a problem in that the two-stage connecting operation is troublesome.

The above two-stage connecting operation is particularly troublesome when one of the two connectors is mounted on a distal end portion of an electronic unit, such as a meter unit or an air-conditioning unit on an instrument panel of an automobile. The manipulation portion of the operating member cannot be driven after the electronic unit is assembled on the instrument panel. Therefore, assemblage of the electronic unit must be completed after the connectors are connected together, resulting in an assembling operation that is quite troublesome.

SUMMARY OF THE INVENTION

To overcome the above-mentioned problems, it is an objective of the present invention to provide a connector connection structure capable of positively connecting a pair of connectors together by a simple operation.

According to the present invention, a connector connection structure comprises a first connector; a second connector connectable to the first connector; a holder having a support portion for supporting the first connector such that the first connector slides in a direction of connection of the second connector to the first connector; at least one swingable lever swingably supported between the holder and the first connector; a drive portion that swingably displaces the at least one swingable lever in response to a sliding movement of the first connector during connection of the second connector to the first connector; and an operating portion that increases a driving force of the swingable lever, and transmits the driving force to the second connector, thereby moving the second connector-in a direction to connect the second connector to the first connector.

In the above preferred structure, the first connector may be displaced by sliding along the support portion of the holder, in response to the operating force, toward the second connector. The swingable lever is swung and displaced in response to the driving force inputted from the drive portion. As the driving force is increased and transmitted to the second connector, the first connector and the second connector are connected together with a large force.

Further, in the connector connection structure of the present invention, the swingable lever may be provided between a wall surface of the holder and a surface of the first connector opposed to the wall surface. Therefore, the swingable lever is prevented from projecting out of the connector-mounting range.

Further in the connector connection structure of the present invention, a plurality of swingable levers may be provided between a wall surface of said holder and a surface of said first connector disposed in opposed relation to said wall surface. Therefore, the drive forces applied from the driving portion are divided into the plurality of the swingable levers.

Furthermore, in the connector connection structure of the invention, at least one pair of swingable levers may be provided in adjacent, facing relation to opposite wall surfaces of the holder, respectively, and the swingable levers are disposed in a point-symmetrical manner.

In the above preferred structure, the driving forces are inputted respectively from the swingable levers to the point-symmetrical portions of the second connector. Consequently, the large connecting forces are applied to the portions of the second connector on a diagonal line.

Furthermore, in the connector connection structure of the present invention, at least one pair of swingable levers may be provided between the holder and the first connector. The swingable levers are positioned on opposite surfaces of the first connector and are swingable in opposite directions toward an inner surface of the holder.

In the above structure, when the first connector is displaced by sliding along the holder, in response to an operating force to connect the first connector and the second connector together, the pair of swingable levers are swingingly displaced in opposite directions, respectively. As a result of the swinging displacement of the swingable levers, drive forces are inputted respectively from the operating portions of the two swingable levers to the second connector.

Furthermore, in the connector connection structure of the present invention the swingable levers may be of the same configuration, allowing efficient mass production of the swingable levers. Furthermore, the opposed swingable levers are preferably disposed in an inverted manner with respect to the swinging direction, such that the levers swing in opposite directions in response to an operating force.

Furthermore, in the connector connection structure of the present invention, a retaining portion for limiting forward withdrawal of the first connector may be formed at a portion of connection between the holder and the first connector.

In the above structure, the retaining portion prevents the first connector, supported in the holder, from being withdrawn from the holder, thus preventing the first connector from being disconnected from the holder. Consequently, the holder and the first connector are kept in a stably-connected condition.

Furthermore, in the connector connection structure of the present invention, a provisionally-retaining portion, for provisionally retaining the first connector in a connection stand-by position, may be provided at a portion of connection between the holder and the first connector. The first connector is provisionally retained by the provisionally-retaining portion until the first connector is released in response to an operating force, which connects the first connector and the second connector together.

In the above structure, before the two connectors are connected together, the first connector is provisionally retained in the connection stand-by position by the provisionally-retaining portion. When the two connectors are to be connected together, an operating force is applied to the first connector to overcome the provisionally-retaining force of the provisionally-retaining portion so that the first connector is allowed to be displaced by sliding along the holder.

Furthermore, in the connector connection structure of the present invention, a provisional retaining-release portion, for urging the provisionally-retaining portion of the first connector into a provisional retaining-release position, is formed on the second connector. When the second connector is to be connected to the first connector, the provisionally-retained condition of the first connector is released by the provisional retaining-release portion.

In the above structure, when the two connectors are to be connected together, the provisional retaining-release portion on the second connector abuts against the provisionally-retaining portion of the first connector and urges the provisionally-retaining portion of the first connector into a provisional retaining-release position, so that the first connector is released, and the first, connector is allowed to be displaced by sliding along the holder.

Furthermore, in the connector connection structure of the present invention, a withdrawal drive portion may be provided between the first connector and the second connector. When the first connector and the second connector are to be disconnected from each other, the withdrawal drive portion slidingly displaces the first connector to withdraw the first connector into the connection stand-by position.

In the above structure, the second connector is pulled to be disconnected from the first connector. The withdrawal drive portion drives the first connector to be slidingly displaced forwardly in response to the movement of the second connector, so that the first connector is moved into the forward connection stand-by position.

Furthermore, in the connector connection structure of the present invention, there is provided a disengagement prevention mechanism for preventing said second connector from being disengaged from said holder during the connection release operation of releasing the connected condition of said first and second connectors, and the condition of disengagement prevention of said second connector by said disengagement prevention mechanism is released when said first connector is withdrawn into the connection stand-by position by said withdrawal drive portion.

Furthermore, in the connector connection structure of the present invention, a limitation portion, which applies a withdrawing resistance to said second connector during the connection release operation of releasing the connected condition of said first and second connectors, is provided between said swingable lever and the operating portion therefor.

Furthermore, in the connector connection structure of the present invention, during the final stage of connection of the second connector to the first connector, the two connectors may be slidingly displaced in unison along the holder.

In the above structure, the two connectors are slidingly displaced a predetermined distance along the holder after the second connector is completely connected to the first connector.

Furthermore, in the connector connection structure of the present invention, a lock mechanism for preventing said second connector, connected to said first connector, from moving in a connection release direction, is provided between said second connector and said holder.

In the above structure, when the first and second connectors are connected, the connecting state is securely maintained by locking the second connector with the holder.

Furthermore, in the connector connection structure of the present invention, a retaining portion for preventing said first connector, supported on said holder, from being withdrawn rearwardly, is provided at a portion of connection between said holder and said first connector.

In the above structure, when the terminal is removed from the first connector, the first connector is prevented from withdrawing rearwardly by the retaining portion.

These and other objects and salient features will be described in or apparent from the following detailed description of preferred embodiments.

BRIEF DESCRIPTION OF THE DRAWINGS

The invention will be described in detail with reference to the following drawings wherein like reference numerals refer to like elements and wherein.

DETAILED DESCRIPTION OF PREFERRED EMBODIMENTS

Figure 1:
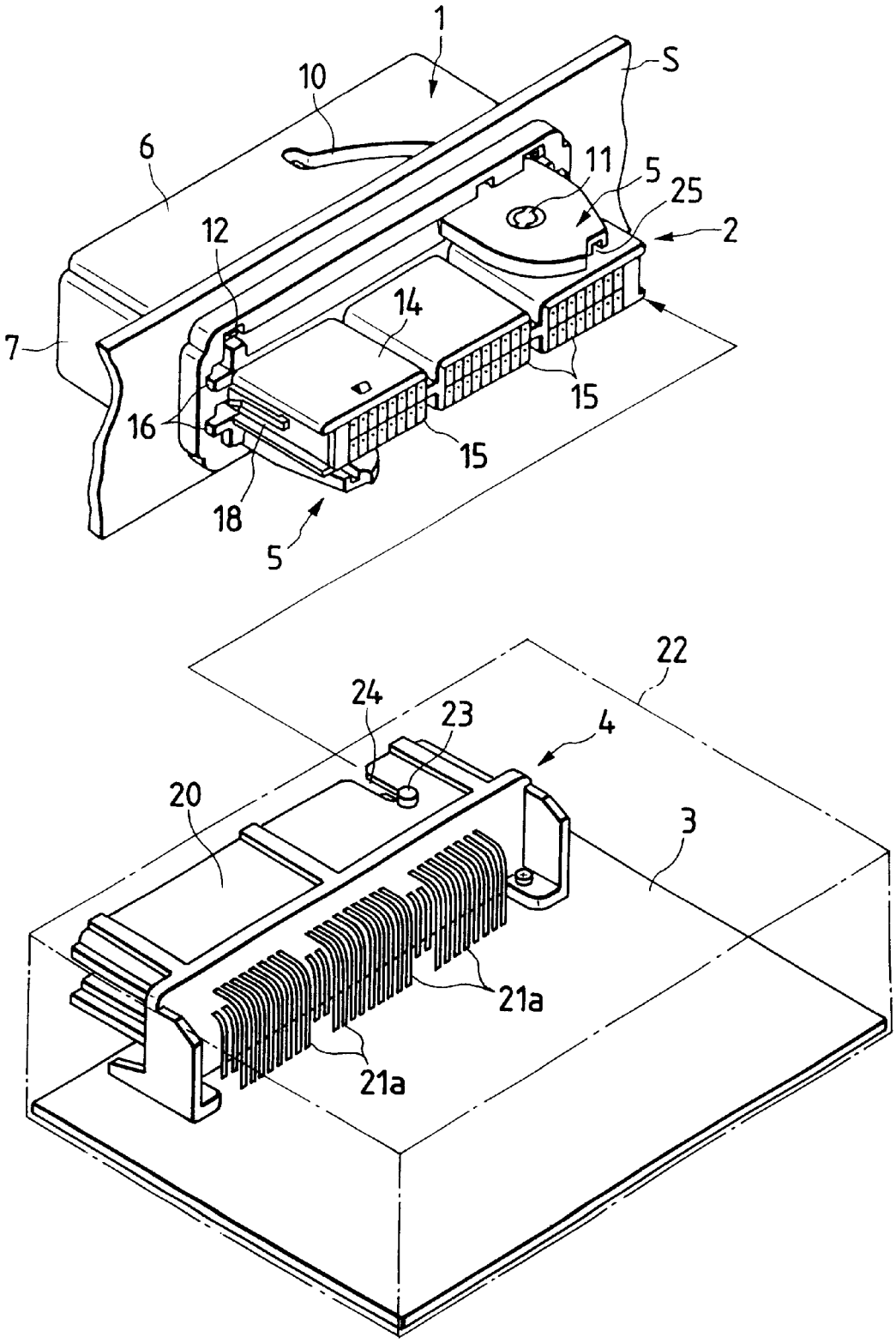
FIG. 1 is a perspective view of a first preferred embodiment of a connector connection structure of the present invention.

FIG. 1 shows a preferred embodiment of a connector connection structure of the present invention. The connector comprises a holder 1 mounted on a mounting portion S such as a stay member of an automobile, a first connector 2 slidably supported by the holder 1, a second connector 4 mounted on a circuit board 3 of an electronic unit 22, and swingable levers 5 for driving the second connector 4 in a direction to connect the second connector to the first connector 2.

Figure 2:
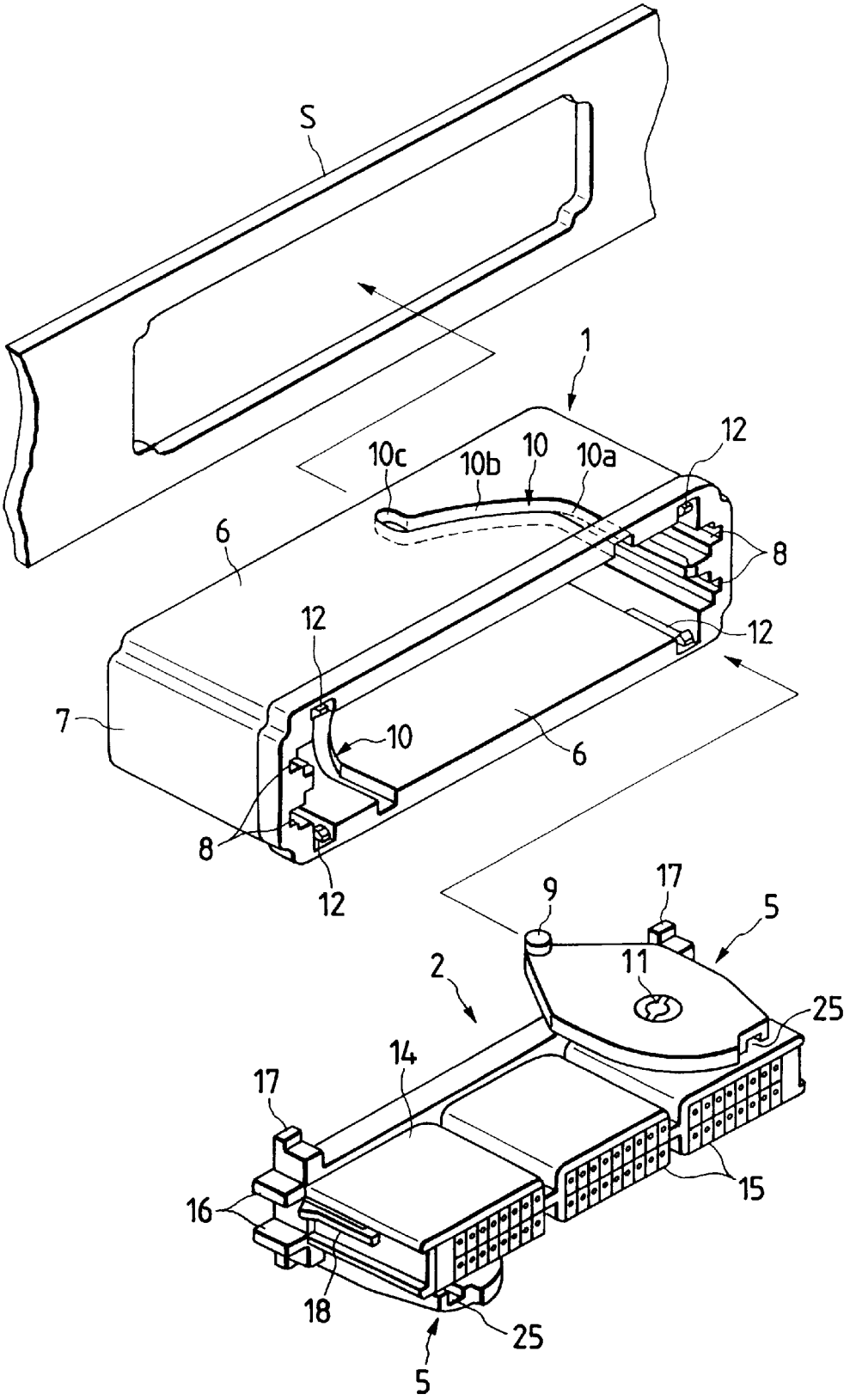
FIG. 2 is an exploded, perspective view showing the specific structure of a first connector.

As shown in FIG. 2, a preferred holder 1 has a tubular shape and comprises a pair of upper and lower horizontal plates 6, and a pair of right and left side plates 7. The holder is fitted in a mounting hole formed through the mounting portion S, and is preferably secured to the mounting portion S by screws or other suitable means. A horizontally-extending support portion, formed by a pair of upper and lower grooves 8 of a U-shaped cross-section, is formed in an inner surface of each of the right and left side plates 7 for slidably supporting the first connector 2.

A guide groove 10 is formed in each horizontal plate 6. Guide groove 10 has an introduction portion 10*a* extending rearwardly from the front side of the holder 1, a drive groove portion 10*b* of an arcuate shape extending rearwardly and inwardly from a rear end of the introduction portion 10*a*, and a retaining groove portion 10*c* extending rearwardly from a rear end of the drive groove portion 10*b*. Drive groove portions 10*a*, 10*b* and 10*c* provide a track for an engagement pin 9 on an outer surface of each swingable lever 5, the pin being at a rear end of swingable lever 5. The drive groove portion 10*b* of the guide groove 10 and the engagement pin 9 cooperate with each other to provide a drive portion which swingingly displaces the swingable lever 5 in response to a sliding displacement of the first connector 2 in a direction toward the second connector.

In this preferred embodiment, although the drive groove portion 10*b* of the guide groove 10 has an arcuate shape, the drive groove portion 10*b*, formed in the holder 1, may linearly extend rearwardly and inwardly from the rear end of the introduction portion 10*a*, or may extend in a curved (e.g. parabolic) manner. The drive groove design can be selected from any design as long as the objectives of the present invention are met.

The guide groove 10 formed in the upper horizontal plate 6, and the guide groove 10 formed in the lower horizontal plate 6, are arranged in a point-symmetrical manner, that is, symmetrical with respect to a point. The swingable lever 5 mounted on the upper side of the first connector 2, and the swingable lever 5 mounted on the lower side of the first connector 2, are swingably displaced in opposite directions, respectively. More specifically, when viewed from the front side of the holder 1, the guide groove 10 formed in the upper horizontal plate 6, is provided at the right side of the upper horizontal plate, and the drive groove portion 10*b* extends left obliquely. When viewed from the front side of the holder 1, the guide groove 10 formed in the lower horizontal plate 6, is provided at the left side of the lower horizontal plate, and the drive groove portion 10*b* extends right obliquely. Thus, the two drive groove portions 10*b* are arranged in opposite directions.

The first connector 2 comprises a female connector housing 14, which is inserted and slidably held in the holder 1, and a plurality of female terminals 15 mounted respectively in terminal receiving chambers in the connector housing 14. A pair of upper and lower projections 16 for sliding movement along the respective U-shaped grooves 8 are formed on each of opposite side surfaces of the connector housing 14 at a rear end portion of connector housing 14. Projections 17, for retaining engagement with associated retaining step portions 12*b*, discussed below, are formed respectively at the upper, lower, right and left surfaces of the rear portion of the connector housing 14.

Figure 3:
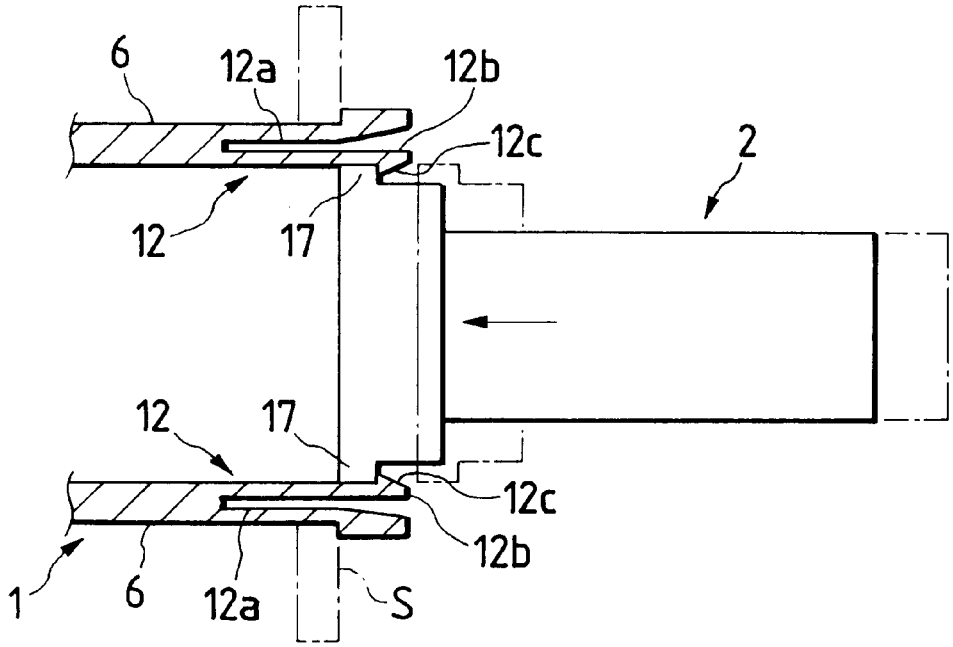
FIG. 3 is a side-elevational, cross-sectional view showing a condition wherein the first connector is retained on a holder by retaining portions.

As shown in FIG. 3, a pair of slits 12*a* are formed, respectively, in right and left end portions of each of the horizontal plates 6 of the holder 1. Slits 12*a* provide retaining portions 12 for retaining the first connector 2 in a front stand-by position. A retaining step portion 12*b*for facing a projection 17, formed on the rear portion of the first connector 2, is formed at a distal end of the retaining portion 12. When a front surface of each projection 17 abuts against a rear surface of the associated retaining step portion 12*b*, the first connector 2 is prevented from being forwardly withdrawn from the holder. The retaining step portion 12*b* has a slanting or tapering surface 12*c*, and a tapering configuration.

Figure 4:
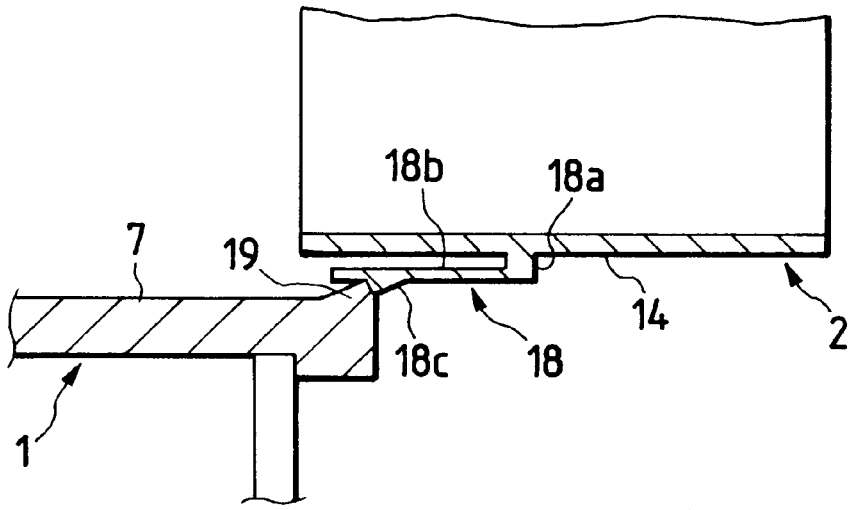
FIG. 4 is a horizontal cross-sectional view showing a condition wherein the first connector is provisionally retained in a connection stand-by position by provisionally-retaining portions.

As shown in FIG. 4, provisionally-retaining portions 18 are formed respectively on the right and left side surfaces of the connector housing 14, and provisionally retain the first connector 2 at the connection stand-by position so that the first connector 2 will not be forced into the holder 1 before the connecting operation (described later) is effected. The provisionally-retaining portion 18 comprises a proximal end portion 18*a* extending from the side surface of the connector housing 14, a plate-like portion 18*b* which extends rearwardly toward holder 1 along a side surface of the connector housing 14, and is spaced a predetermined distance from the side surface, and a projection 18*c* formed on an outer surface of the plate-like portion 18*b* at a rear end portion of plate-like portion 18*b*. The projection 18*c* of the provisionally-retaining portion 18 preferably has a triangular shape when seen in a plan view, and has a pair of slanting (tapering) outer surfaces.

Projections 19 are preferably formed on left and right front sides of the holder 1. Each projection 19 has a pair of slanting (tapering) surfaces corresponding, respectively, to the slanting surfaces of associated projection 18*c* of provisionally-retaining portion 18. When the rear slanting surfaces of projections 18*c* of the provisionally-retaining portion 18 abut, respectively, against the front slanting surfaces of projections 19 formed on the holder 1, the first connector 2 is provisionally retained in a connection stand-by position.

Figure 5:
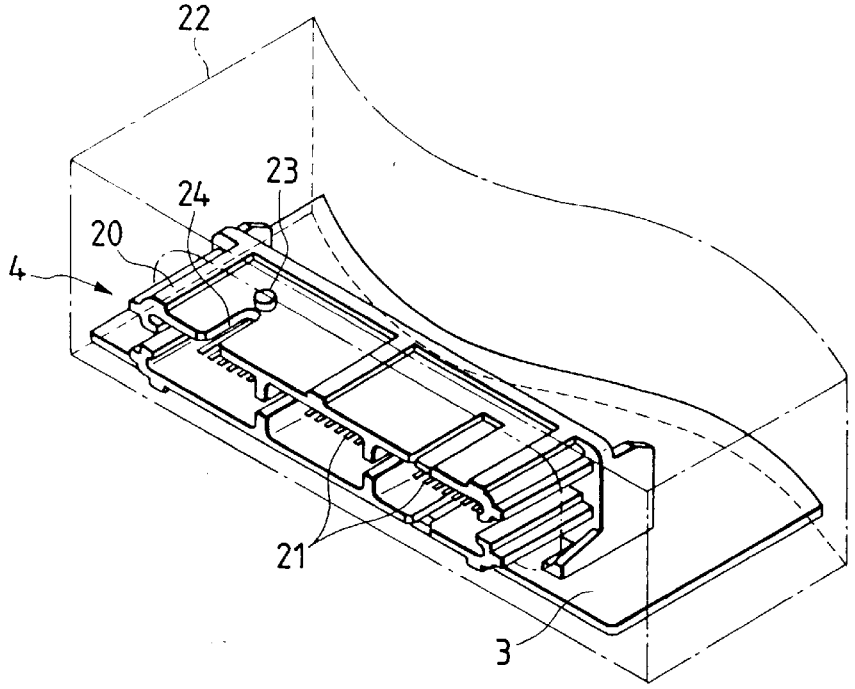
FIG. 5 is a perspective view showing the specific structure of a second connector.

As shown in FIG. 5, the second connector 4 comprises a male connector housing 20, for fitting on the connector housing 14 of the first connector 2, and a plurality of male terminals 21 mounted, respectively, in terminal receiving chambers in the connector housing 20. The connector housing 20 is preferably secured to the circuit board 3 by screws or other suitable means. Connection portions 21*a* of the male terminals 21 extend outwardly from the rear side of the connector housing, and are preferably connected by soldering, or other means, to conductor portions on the circuit board 3 (see FIG. 1).

The second connector 4 and the circuit board 3 are mounted within a casing of the electronic unit 22. A pair of driving pins 23 are formed, respectively, on upper and lower walls of the connector housing 20, and are driven by the swingable levers 5, respectively. A pair of slits 24 are formed, respectively, in upper and lower walls of the connector housing 20 such that slits 24 are disposed in registry with swing pivots 11 of the swingable levers 5, respectively.

Figure 6:
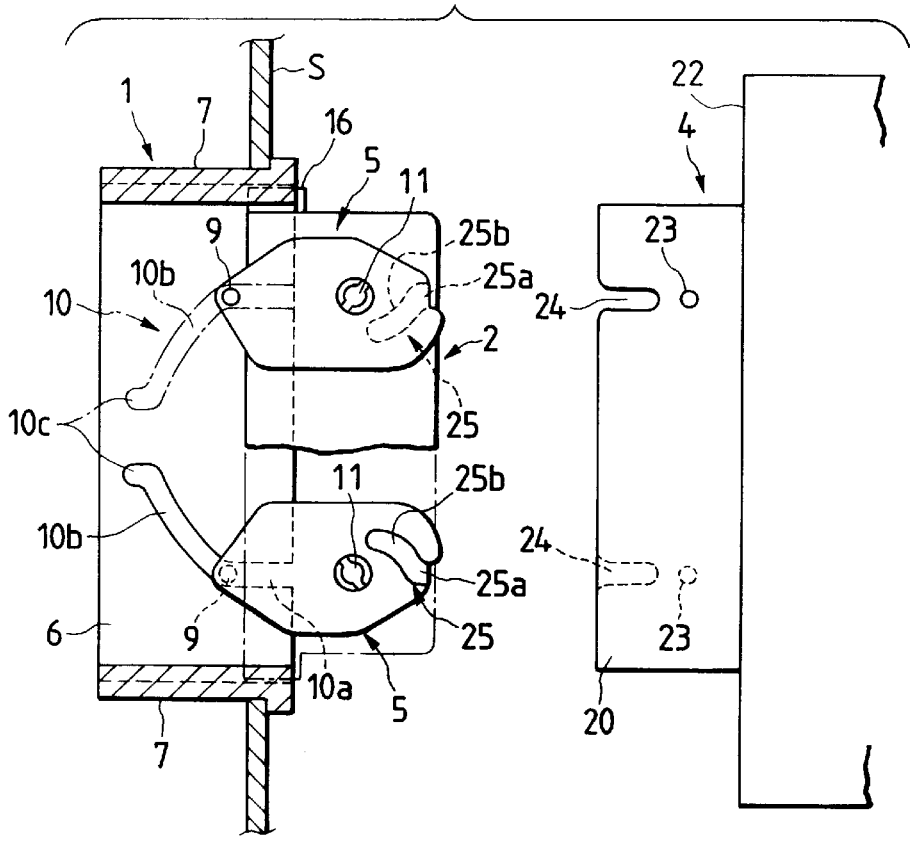
FIG. 6 is a horizontal cross-sectional view showing a condition before the first and second connector are connected together.

As shown in FIG. 6, the swingable levers 5 are swingably supported on the connector housing 14 of the first connector 2 by respective swing pivots 11, each swing pivot 11 comprising a support pin or other support means. The swingable levers 5 are disposed, respectively, in registry with the guide grooves 10 formed in the holder 1. The engagement pin 9, formed on the outer surface at the rear end of each swingable lever 5 (that is, the upper surface of the upper swingable lever 5, and the lower surface of the lower swingable lever 5) is fitted in the guide groove 10.

An engagement groove 25 is formed in the reverse surface of each swingable lever 5 (that is, the lower surface of the upper swingable lever 5, and the upper surface of the lower swingable lever 5) at a front end portion of each swingable lever 5. Driving pins 23, formed on the connector housing 20 of the second connector 4, are engageable with the engagement grooves 25, respectively.

The engagement groove 25 in the swingable lever 5 has an opening portion 25*a*, serving as an introduction portion for the driving pin 23, and an operating groove portion 25*b* continuously extending rearwardly from the opening portion 25*a* toward an inner side of the swingable lever 5. The distance from the operating groove portion 25*b* to the swing pivot 11 decreases progressively from the front end of groove portion 25*b* toward its rear end. With this arrangement, the operating groove portion 25*b* and the driving pin 23 of the second connector 4 cooperate with each other to provide an operating portion, which transmits the driving force inputted to the swingable lever 5 from the above-mentioned drive portion, to the second connector 4.

More specifically, the distance from the operating groove portion 25*b* to the swing pivot 11 is designed such that the operating groove portion 25*b* approaches the swing pivot 11 progressively from its front end toward its rear end. With this arrangement, connection of the first and second connectors 2 and 4 is accomplished by forcing or pushing the first connector 2 into the holder 1. The first connector is slidingly displaced, and in response to the sliding displacement of the first connector 2, each driving pin 23 of the second connector 4 is drawn toward the associated swing pivot 11, thereby moving the second connector 4 toward the first connector 2.

The position of the drive groove portion 10*b* of each guide groove 10 relative to the associated swing pivot 11, the position of the operating groove portion 25*b* of each engagement groove 25 relative to the associated swing pivot 11, and their configurations are designed such that the amount of movement of the second connector 4 in the connecting direction is smaller than the amount of movement of the first connector 2 resulting from forcing or pushing into the holder 1. With this arrangement, the driving force inputted to the swingable lever 5 from the drive portion is increased, and is transmitted to the driving pin 23 of the second connector 4 from the operating groove portion 25*b*.

For connecting the first connector 2 and the second connector 4 together, the first connector 2 has female terminals 15 mounted in the female connector housing 14. Female terminals 15 are opposed to the front opening of the holder 1 as shown in FIG. 2. The connector housing 14 is pushed in a direction, indicated by the arrow, to be inserted into the holder 1, thereby setting the first connector 2 in the connection stand-by position as shown in solid lines in FIG. 3.

More specifically, by insertion of the first connector 2 into the holder 1, the projections 17 of the connector housing 14 are pressed respectively against the slanting surfaces 12*c* of the retaining portions 12, formed on the horizontal plates 6 of the holder 1. Projections 17 elastically deform retaining portions 12. Then, the projections 17 pass the retaining step portions 12*b* of the retaining portions 12, and are received in the holder 1. The projections 18*c* of the provisionally-retaining portions 18, formed on the opposite sides of the connector housing 14, are abutted respectively against the front surfaces of the projections 19 formed on the side plates 7 of the holder 1. In this condition, the first connector 2 is provisionally retained in the connection stand-by position.

When the first connector 2 is inserted, the engagement pins 9, formed respectively at the rear ends of the swingable levers 5, are introduced respectively into the guide grooves 10 in the holder 1. The engagement pins 9 are disposed respectively at the rear end portions of the introduction portions 10*a* of the guide grooves 10 when first connector 2 is in the connection stand-by position.

Then, the holder 1 is secured to the mounting portion S of a vehicle body. The electronic unit 22, having the second connector 4 mounted thereon, is opposed to the first connector 2. The electronic unit is pushed, so that the connector housing 20 of the second connector 4 is fitted on the connector housing 14 of the first connector 2, thereby electrically connecting the first connector 2 and the second connector 4 together.

Figure 7:
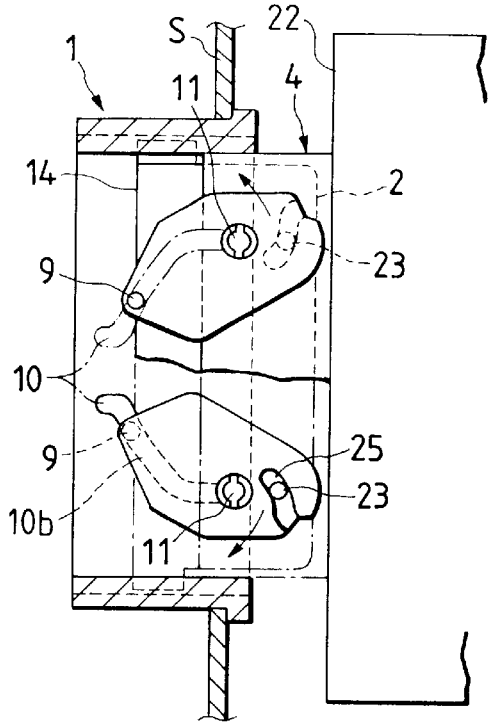
FIG. 7 is a horizontal cross-sectional view showing the process of connecting the second connector to the first connector.

During the process of connecting connectors 2 and 4 together, the first connector 2 is pushed rearwardly by the second connector 4. The rearward force causes the projections 18*c* of the provisionally-retaining portions 18, formed respectively on the opposite side surfaces of the first connector 2, to be pressed by the projections 19 on the holder 1, respectively. The plate-like portions 18*b* of the provisionally-retaining portions 18 are elastically deformed. When the rearward force exceeds the provisionally-retaining force, projections 18*c* of the provisionally-retaining portions 18 pass the respective projections 19 of the holder 1 and the connector housing 14 of the first connector 2 is slidingly displaced rearwardly along the support portions of the holder 1 as shown in FIG. 7. The driving pins 23 of the second connector 4 are introduced, respectively, into the engagement grooves 25 of the swingable levers 5, and thus are engaged with the swingable lever 5, respectively.

Furthermore, when the second connector 4 is further pushed to slidingly displace the first connector 2 rearwardly, the engagement pins 9 of the swingable levers 5, supported on the first connector 2 slide respectively along the drive groove portions 10*b* of the guide grooves 10, so that the rear end portions of the swingable levers 5 move inwardly toward the central rear end of the holder 1 as the swingable levers 5 are swingingly displaced about the respective swing pivots 11. In response to the swinging displacement of each swingable lever 5, the associated driven pin 23 on the second connector 4 slides along the operating groove portion 25*b*, formed in the front end portion of the swingable lever 5, so that the driven pin 23 is drawn toward the swing pivot 11, and the second connector 4 is moved toward the first connector 2.

The amount of movement of the second connector 4, driven by the swingable levers 5, in the connecting direction is smaller than the amount of displacement of the first connector 2, which swingingly displaces the swingable levers 5. The resulting driving force inputted to each swingable lever 5 from the drive portion is increased, and is simultaneously transmitted to the associated driving pin 23 from the operating groove portion 25*b*. Consequently, in response to the driving forces inputted respectively to the driving pins 23 from the drive groove portions 25*b* of the swingable levers 5 in response to the sliding displacement of the first connector 2, the second connector 4 is pushed toward the first connector 2 with a large force, resulting in the first connector 2 and the second connector 4 being positively connected together.

Figure 8:
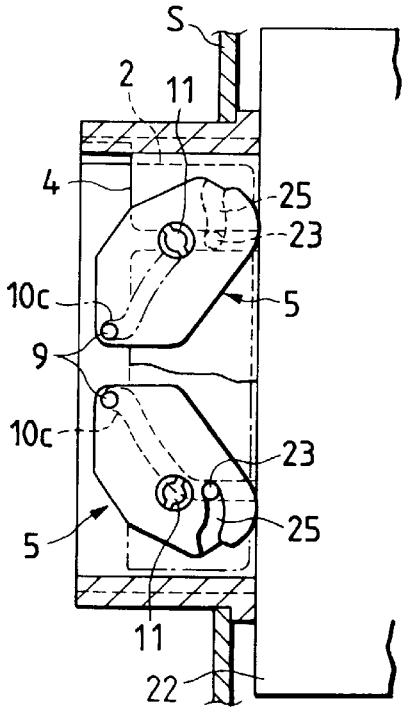
FIG. 8 is a horizontal cross-sectional view showing a condition wherein the first and second connectors are connected together.

Then, at the final stage of the connection of the second connector 4 to the first connector 2, the engagement pin 9 of each swingable lever 5 is introduced into the retaining groove portion 10*c* of the associated guide groove 10. The engagement pin 9 moves straight toward the rear end of the holder 1 as shown in FIG. 8, so that the first connector 2 and the second connector 4 are slidingly displaced in unison along the support portions of the holder 1, without swingingly displacing the swingable levers 5.

For disconnecting the first connector 2 and the second connector 4 from each other, the electronic unit 22 is pulled to slidingly displace the second connector 4 to a connection release position, so that the swingable levers 5 are swingingly displaced in directions opposite to the swinging directions during the connecting operation. The swingable levers 5 and the first connector 2 are slidingly displaced forwardly, and then the two connectors 2 and 4 are disconnected from each other.

As described above, the first connector 2 is preferably supported by the holder 1 mounted on the mounting portion S, for sliding movement in its connecting direction. The swingable levers 5 are swingingly displaceable in response to the sliding displacement of the first connector 2. The driving force is increased in response to the swinging displacement of the swingable levers 5, and is transmitted to the second connector 4, thereby driving the second connector 4 in the direction toward the first connector 2. With the above structure, a simple operation of merely pushing the second connector 4 relative to the first connector 2 in a connection direction connects the two connectors 2 and 4 with a large connecting force.

Moreover, in a multi-pole connector, which includes multiple female terminals 15 mounted in a first connector 2, multiple male terminals 21 mounted in a second connector 4, and requires a large connecting force, the multi-pole connectors 2 and 4 can be positively connected with a single operation.

An additional advantage of the present invention is apparent when the second connector 4 is mounted on a rear side of an electronic unit 22, such as a meter unit, an air-conditioning unit or a navigation unit of an automobile, and the first connector 2 is mounted on, the bottom of a mounting hole in which the electronic unit 22 is mounted. In such a situation, even when the hand of the operator can not be inserted into the connecting portion of the two connectors 2 and 4, the two connectors 2 and 4 can be connected together easily and positively.

In the above embodiment, each swingable lever 5 is provided between the inner surface of the holder 1 and the outer surface of the first connector 2, facing the holder 1. The swingable levers 5 do not project beyond a connector-mounting portion, and therefore, do not form any dead space and are allowed to be swingingly displaced. Furthermore, the swingable lever 5 has a plate-like configuration and a small thickness, enabling the vertical dimension of the connector to remain substantially small, relative to connectors without such swingable levers.

In the above embodiment, the swingable levers 5 are provided in adjacent, facing relation to the upper and lower inner surfaces of the holder 1, respectively, and are disposed in a point-symmetrical manner. The simple structure provides uniform connecting forces to the two connectors 2 and 4, so that the two connectors are properly and easily connected together.

In a further embodiment, where the width of the connector is large, the swingable levers 5 are provided respectively on opposite side portions of the connector. In this embodiment, the connecting forces act respectively on opposite side portions of the connector along a diagonal line of the connector. This effectively prevents an improper connection, which would otherwise result from the localized application of the connecting force on one side portion of the second connector 4.

In the above further embodiment, the swingable levers 5 are provided in adjacent, facing relation to opposed right and left inner surfaces of the holder 1. The swingable levers 5 are swingingly displaceable in opposite directions, respectively. In this embodiment, the driving forces, transmitted respectively from the two swingable levers 5 to the second connector 4, are exerted in the opposite directions, respectively, as shown in FIG. 7. The widthwise components of the driving forces, transmitted respectively from the two swingable levers 5 to the second connector 4, cancel each other. Therefore, the second connector 4 is displaced by sliding straight along the holder 1 and is properly connected to the first connector 2.

In the above embodiment, at least one pair of swingable levers 5 of the same configuration are provided in adjacent, facing relation to the opposed side surfaces of the holder 1, and the opposed swingable levers 5 are disposed in an inverted manner with respect to their opposite sides. Consequently, the number of dissimilar component parts is reduced, and the productivity of component parts is enhanced. Further, the directions of swinging motion of the two swingable levers 5 are opposite, so that the second connector 4 is slidingly displaced in a straight direction as described above.

Figure 9:
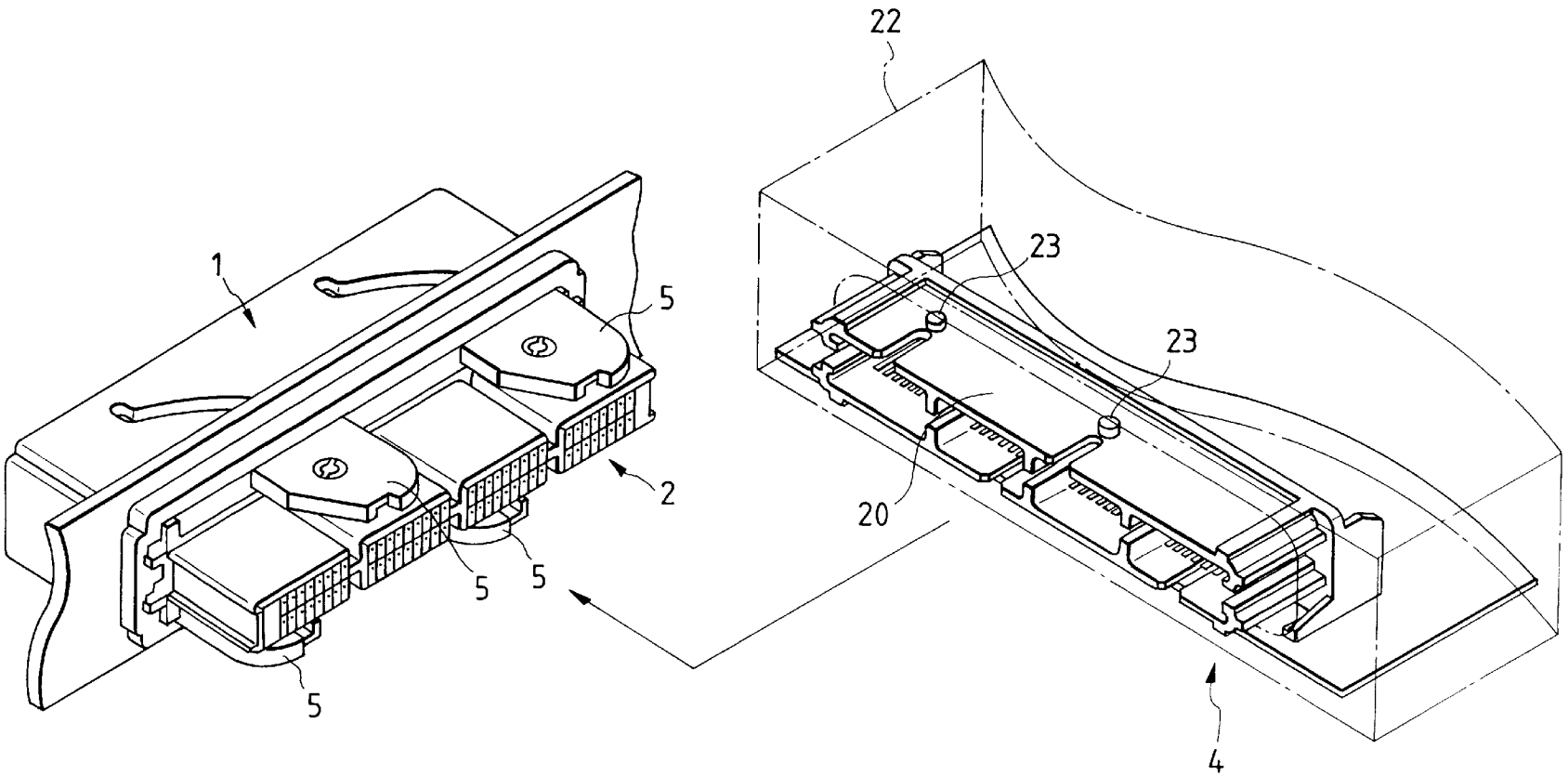
FIG. 9 is a perspective view showing another embodiment of a connector connection construction of the invention.

As an alternative embodiment to the above structure, the swingable lever 5 may be provided on only one of the upper and lower sides of the first connector 2. Also, as shown in FIG. 9, there may be provided a construction in which a pair of right and left swingable levers 5 (or more than two swingable levers 5) are provided on each of the upper and lower sides of the first connector 2, and driven pins 23, corresponding in number to the swingable levers 5, are formed on the connector housing 20 of the second connector 4. Where the pair of swingable levers 5 are provided on each side, the directions of swinging motion of these levers do not always need to be opposite, but the two swingable levers 5 may be swingingly displaceable in the same direction.

As described above, in the construction in which the plurality of swingable levers 5 are provided between the wall surface of the holder 1 and the surface of the first connector 2 opposed thereto, when connecting the first and second connectors 2 and 4 together, a uniform connecting force can be exerted at a plurality of portions in the direction of the width thereof, and therefore even if the connector width is large, the first and second connectors 2 and 4 are prevented from tilting relative to each other, and hence can be suitably connected together. And besides, the driving force, inputted per swingable lever 5 in accordance with the pushing of the second connector 4, can be reduced, and therefore the diameter of the swing pivots 11 of the swingable levers 5 can be reduced, and also the thickness of the plate of the swingable lever 5 can be reduced. Thus, there is an advantage that the overall size of the connector can be reduced.

In the above embodiment, as shown in FIG. 3, the retaining portions 12 for preventing the first connector 2 from being withdrawn forwardly are formed on the horizontal plate 6 of the holder 1, and the projections 17, corresponding respectively to the retaining step portions 12*b* of the retaining portions 12, are formed on the connector housing 14 of the first connector 2. Therefore, by abutting the projections 17 respectively against the retaining step portions 12*b*, the holder 1 and the first connector 2 can be kept in the stably-connected condition.

The retaining step portion 12*b* has a slanting surface 12*c* and a tapering configuration. Slit 12*a* is provided between the horizontal plate 6 of the holder 1 and each retaining portion 12. Each projection 17 on the connector housing 14 is pressed against the slanting surface 12*c* of the associated retaining step portion 12*b* to elastically deform the retaining portion 12. In this case, the connection of the first connector 2 to the holder 1 is easily effected with one touch. Furthermore, by elastically deforming the retaining portions 12, the first connector 2 is withdrawn outwardly from the holder 1.

In the above embodiment, the provisionally-retaining portions 18 are formed respectively on the right and left side surfaces of the connector housing 14 of the first connector 2, as shown in FIG. 4. The projections 18*c* of the provisionally-retaining portions 18 are held against the front side of the holder 1, thereby provisionally retaining the first connector 2 in a connection stand-by position. With such a simple structure, the first connector 2 is effectively prevented from being pushed into the holder 1 prior to the connecting operation.

As described above, the provisionally-retaining portion 18 comprises a proximal end portion 18*a* extending from a side surface of the connector housing 14, the plate-like portion 18*b* which extends in a direction toward the holder 1 along the side surface of the connector housing 14, and the projection 18*c* formed on the outer surface of the plate-like portion 18*b* at the distal end portion thereof. The projection 18*c* has a pair of slanting (tapering) outer surfaces.

Projections 19 each have a pair of slanting (tapering) surfaces corresponding respectively to the slanting surfaces of the associated projection 18*c*. Projections 19 are formed at the front side of the holder 1. In this case, when the two connectors 2 and 4 are to be connected together, the mating tapering surfaces are pressed against each other to elastically deform each plate-like portion 18*b*. When the pressing force becomes greater than the provisionally-retaining force, the provisionally-retained condition is overcome.

In the above-mentioned embodiment, when the two connectors are to be connected together, the tapering surface of the projection 18*c* of each provisionally-retaining portion 18 is pressed against the tapering surface of the associated projection 19 on the front side of the holder 1. The provisionally-retaining portion 18 is elastically deformed, thereby releasing the provisionally-retained condition of the first connector 2.

Figure 10:
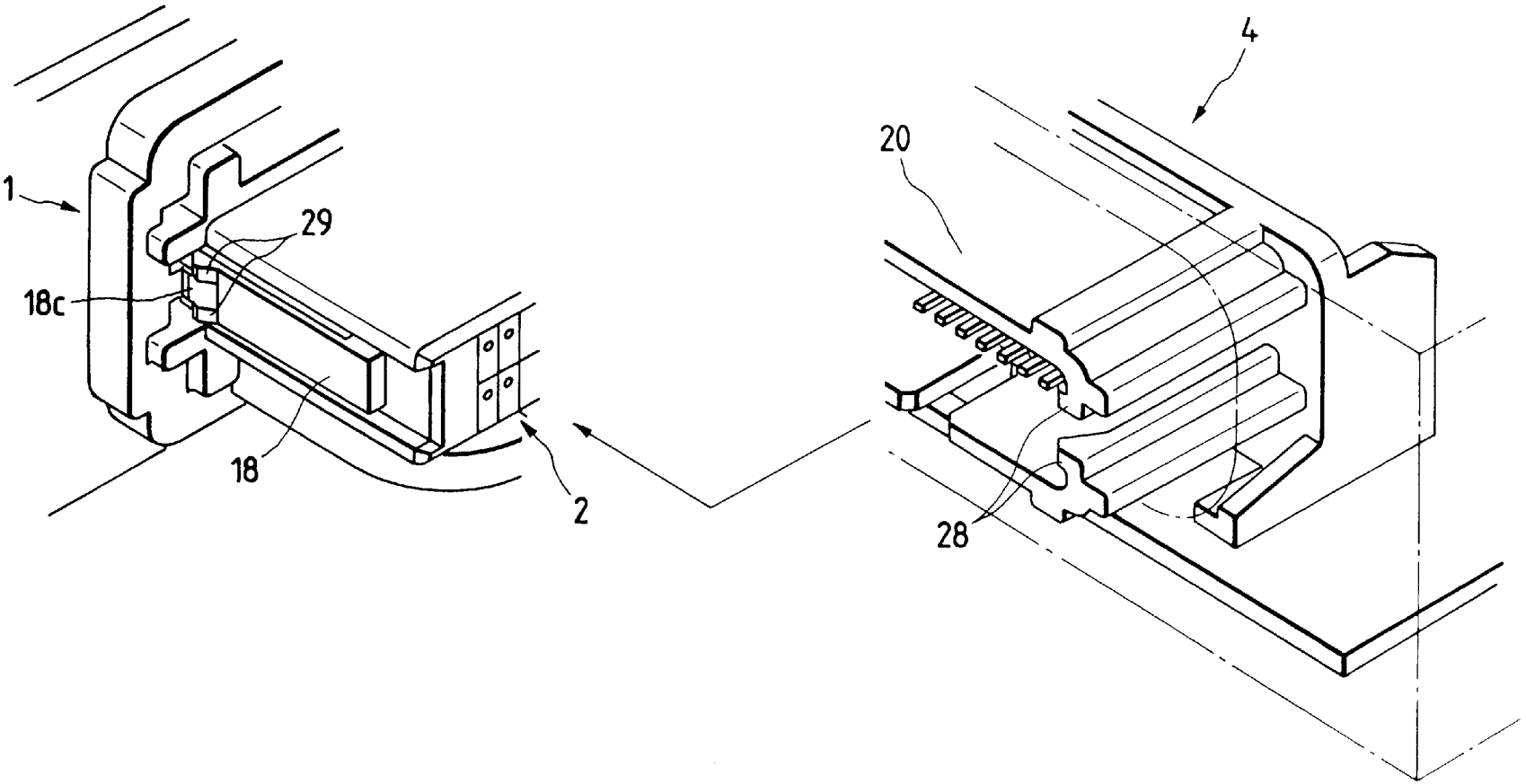
FIG. 10 is a perspective view showing a second preferred embodiment of a connector connection structure of the present invention.
Figure 11:
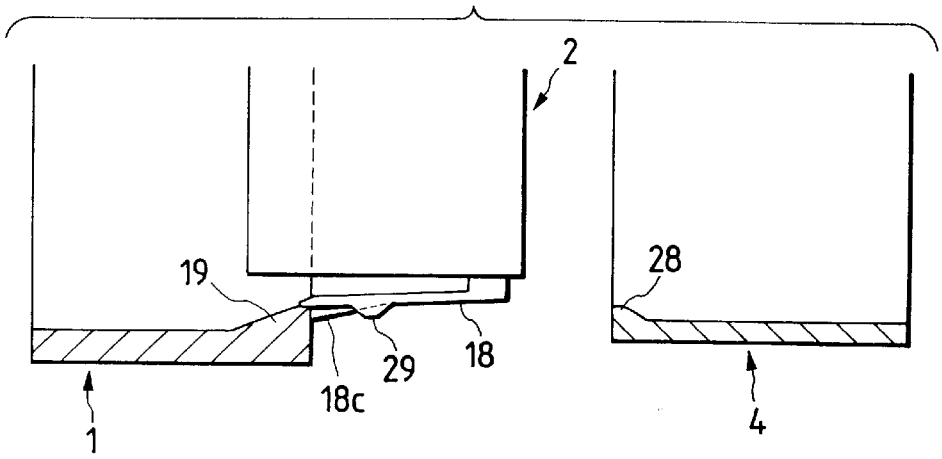
FIG. 11 is a cross-sectional view of the second preferred embodiment, showing a condition before connectors are connected together.

In an alternative structure of the above embodiment, there may be provided a structure wherein projections 28 (provisional retaining-release portions) for respectively pressing the provisionally-retaining portions 18 into their provisional retaining-release positions, are formed on the connector housing 20 of the second connector 4. In this embodiment, an additional projection 29 is formed on an outer surface of each provisionally-retaining portion 18 at a rear end portion thereof, as shown in FIGS. 10 and 11. The additional projection 29 provides a surface against which the associated projection 28 can abut.

Figure 12:
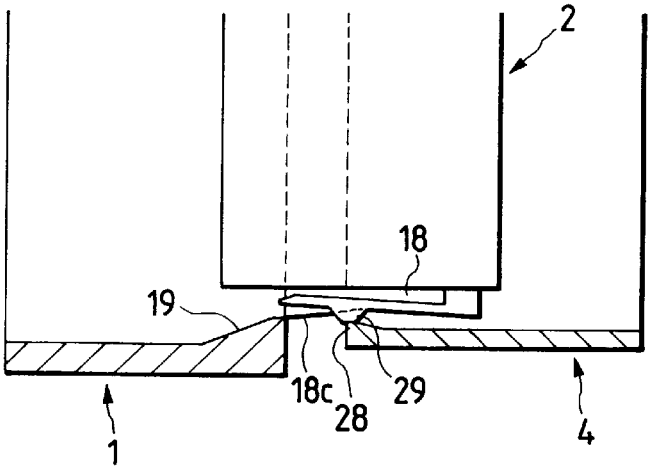
FIG. 12 is a cross-sectional view of the second preferred embodiment, showing the process of connecting the connectors together.

When the second connector 4 is to be connected to the first connector 2, each projection 28 on the second connector 4 is abutted against the projection 29 of the associated provisionally-retaining portion 18 to pivotally move the provisionally-retaining portion 18 into the provisional retaining-release position, thereby reducing the provisionally-retaining force on the first connector 2, as shown in FIG. 12.

In this construction, the retaining projections 18*c* do not need to be formed respectively on the rear end portions of the provisionally-retaining portions 18, and also the tapering surfaces for elastically deforming the provisionally-retaining portions 18 do not need to be formed respectively on the projections 19 of the holder 1, and therefore advantageously, the rear surface of each retaining projection 18*c* can be formed perpendicularly to the connector connecting direction, so that the first connector 2 can be stably retained in the connection stand-by position. And besides, when connecting the first and second connectors 2 and 4, the projection 28 is abutted against the projection 29 of the provisionally-retaining portion 18, and by doing so, the provisionally-retained condition, effected by the provisionally-retaining portion 18, is positively released, and the first connector 2 is slidingly displaced along the holder 1 so that the two connectors 2 and 4 can shift into the connected condition.

Figure 13:
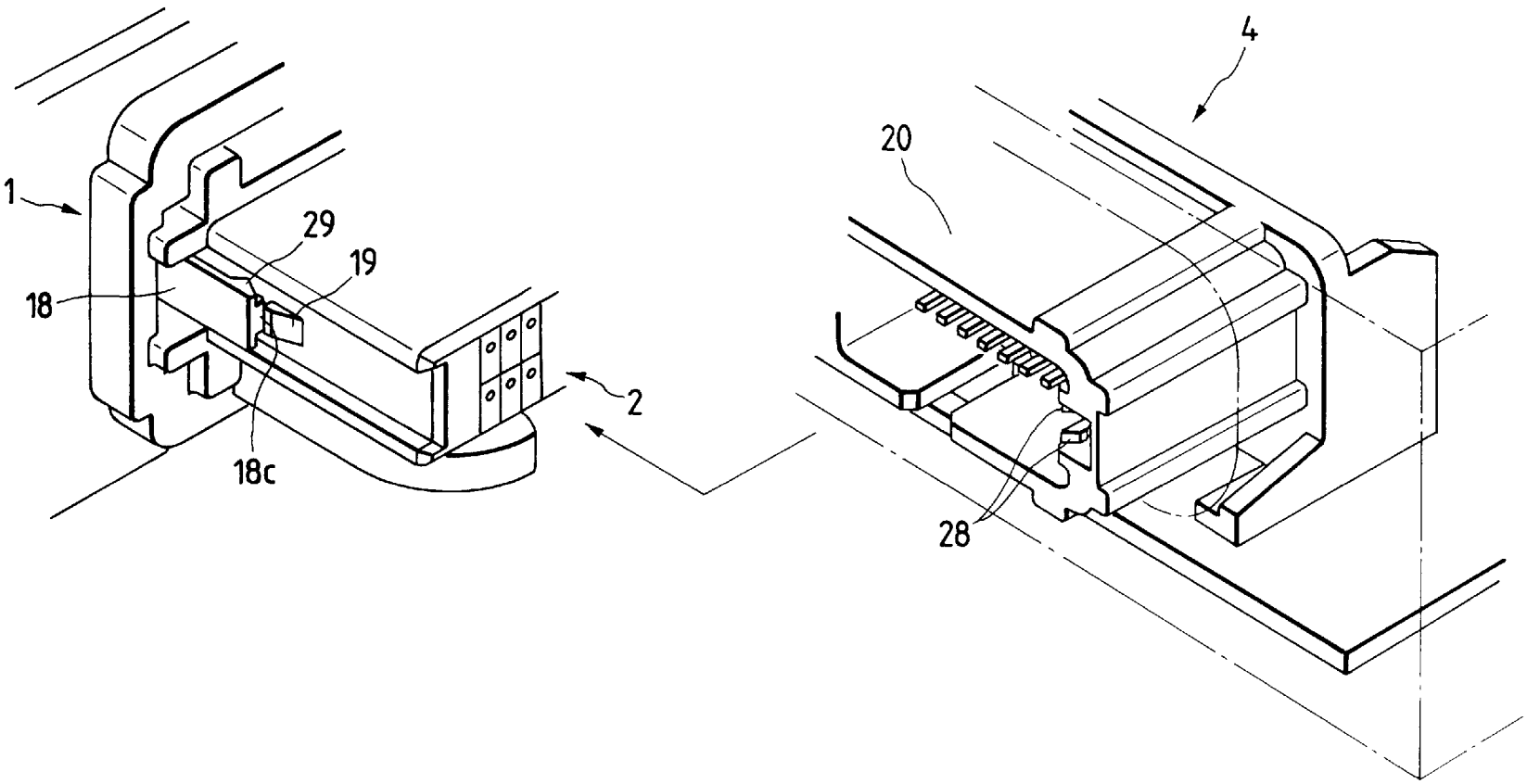
FIG. 13 is a perspective view showing a third preferred embodiment of a connector connecting structure of the present invention.
Figure 14:
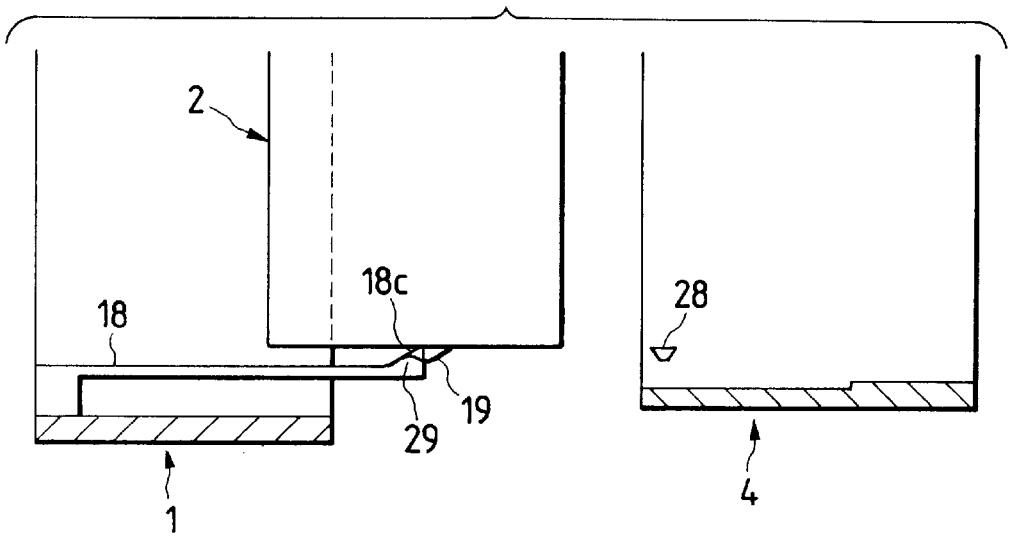
FIG. 14 is a cross-sectional view of the third preferred embodiment, showing a condition before connectors are connected together.

In the above embodiment, the provisionally-retaining portions 18 are formed on the connector housing 14 of the first connector 2. In a further embodiment, a structure is provided wherein plate-like provisionally-retaining portions 18 are formed on the holder 1, projections 19 are formed on side surfaces of the first connector 2, and each projection 19 abuts against a retaining projection 18*c* formed on a distal end of the associated provisionally-retaining portion 18. This configuration retains the first connector 2 in a connection stand-by position, as shown in FIGS. 13 and 14.

Figure 15:
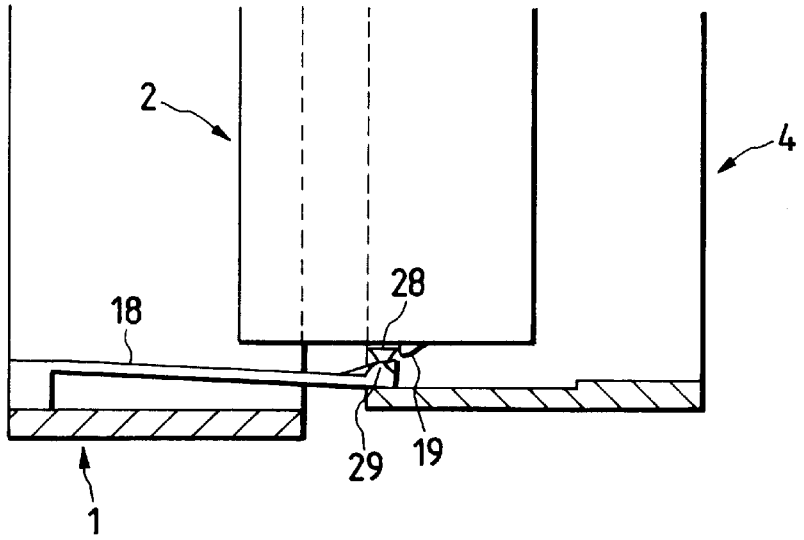
FIG. 15 is a cross-sectional view of the third preferred embodiment, showing the process of connecting the connectors together.

In this particular embodiment, projections 28 are formed on the second connector 4. Each projection 28 elastically deforms the associated provisionally-retaining portion 18 into a provisional retaining-release position when the second connector 4 is to be connected to the first connector 2. A projection 29, for abutment against the associated projection 28, is formed at the distal end of each provisionally-retaining portion 18. Further, each projection 28 is pressed against the associated projection 29 to pivotally move the provisionally-retaining portion 18, thereby releasing the provisionally-retained condition of the first connector 2, as shown in FIG. 15.

Instead of providing the provisionally-retaining portions 18 described above, an urging member for urging the first connector 2 forward is provided in a structure of a further preferred embodiment. In this embodiment, an urging force of the urging member forces the projections 15 on the connector housing 14 respectively against the retaining step portions 12*b* of the retaining portions 12, thereby retaining the first connector 2 in the connection stand-by position.

Figure 16:
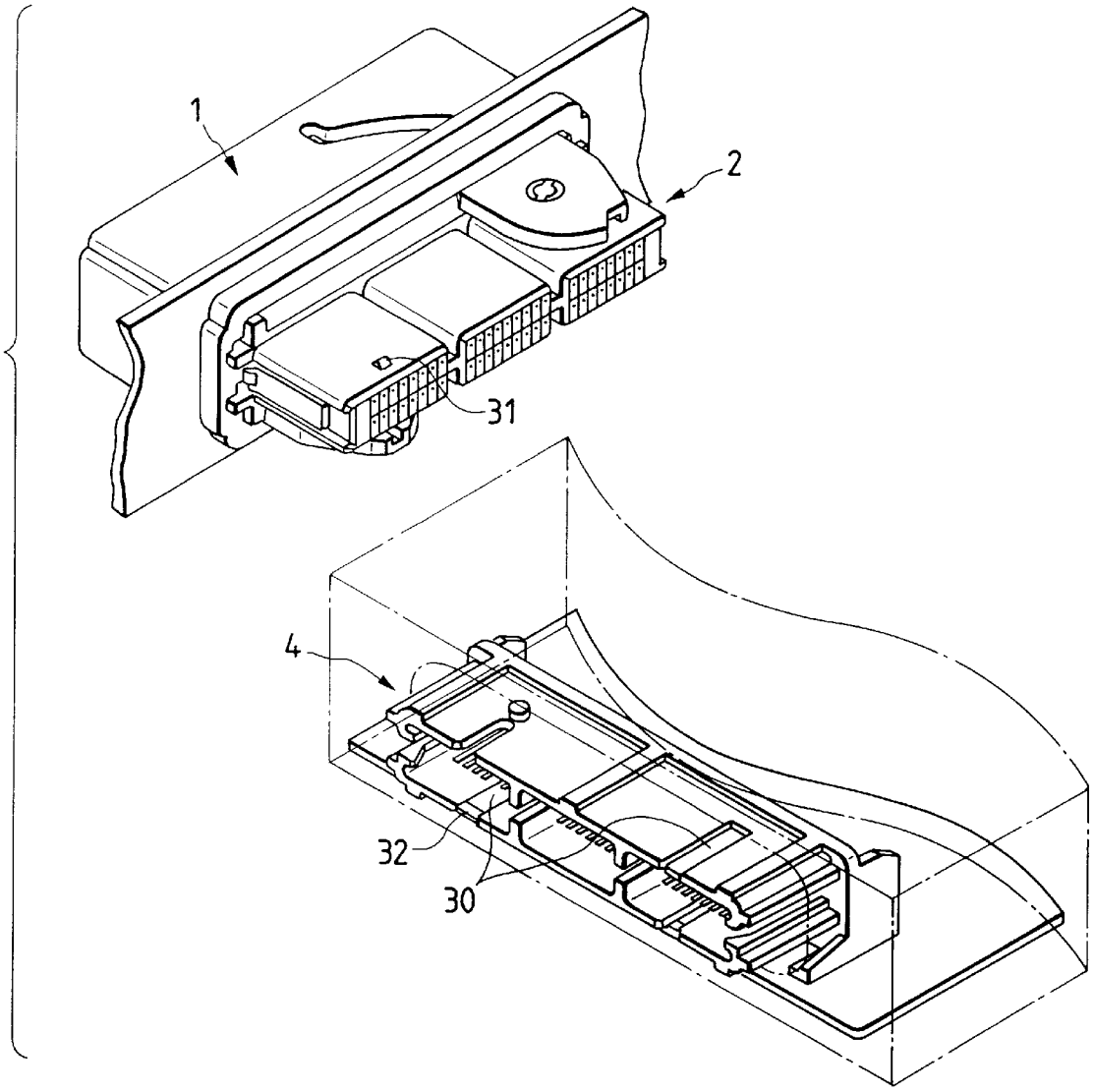
FIG. 16 is a perspective view of a fourth preferred embodiment of a connector connection structure of the present invention.
Figure 17:
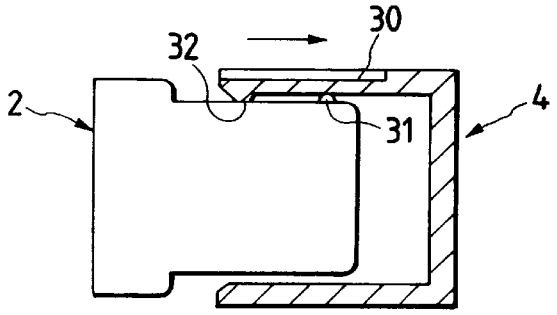
FIG. 17 is a perspective view showing the operation of the fourth preferred embodiment.

As shown in FIGS. 16 and 17, a structure is provided wherein plate-like withdrawal drive portions 30, for slidingly displacing or withdrawing the first connector 2 into the connection stand-by position when the first connector 2 and the second connector 4 are to be disconnected from each other, are formed respectively on the upper wall and bottom wall of the second connector 4. Projections 31 are formed on the first connector 2, and a projection 32 of a tapering configuration, having a pair of tapering surfaces, is formed on a distal end portion of each withdrawal drive portion 30.

In this preferred structure, when the first and second connectors 2 and 4 are to be connected together, the front tapering surface of each projection 32 is pressed against the associated projection 31 on the first connector 2, thereby elastically deforming the withdrawal drive portion 30. As a result, the distal end portion (and hence the projection 32) of the withdrawal drive portion 30 is advanced toward the rear side of the first connector 2. When the two connectors are to be disconnected from each other, the second connector 4 is pulled in a direction of an arrow in FIG. 17, and the rear tapering surface of each projection 32 is abutted against the associated projection 31 on the first connector 2. When the second connector 4 is further pulled or slidingly displaced to withdraw the first connector 2 toward the front side of the holder 1, the displacement of the second connector automatically moves the first connector 2 into the connection stand-by position shown in FIGS. 3 and 4.

Figure 18:
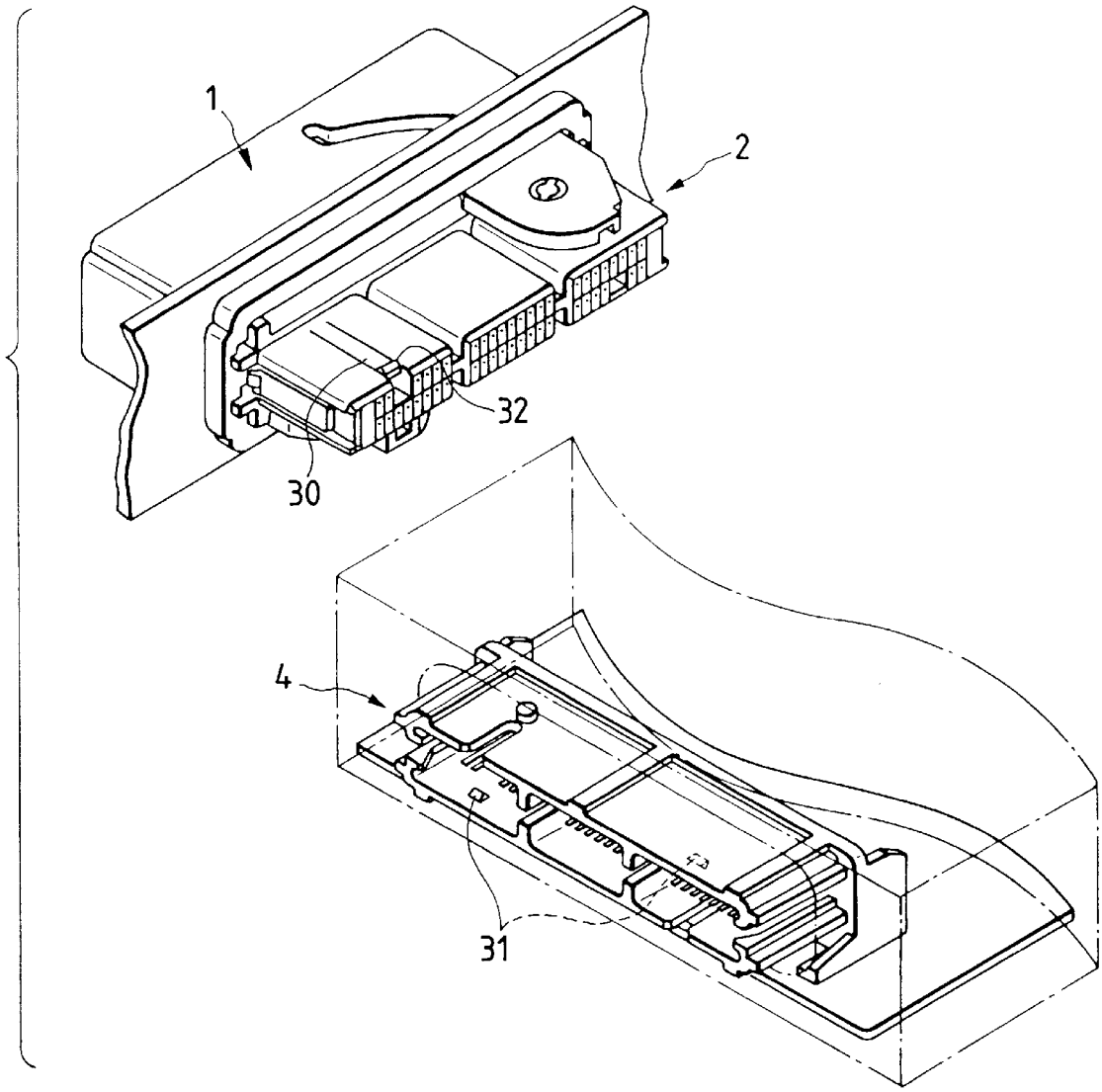
FIG. 18 is a perspective view of a fifth preferred embodiment of a connector connection structure of the present invention.
Figure 19:
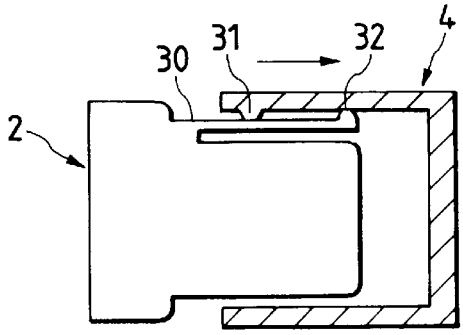
FIG. 19 is a view showing the operation of the fifth preferred embodiment.

As shown in FIGS. 18 and 19, a further structure is provided wherein plate-like withdrawal drive portions 30 are formed on the first connector 2, and projections 31 for abutting respectively against projections 32 of the withdrawal drive portions 30 are formed on the second connector 4. By pulling the second connector 4 away from the first connector, the first connector 2 is slidingly displaced toward the front side of the holder 1.

Figure 20:
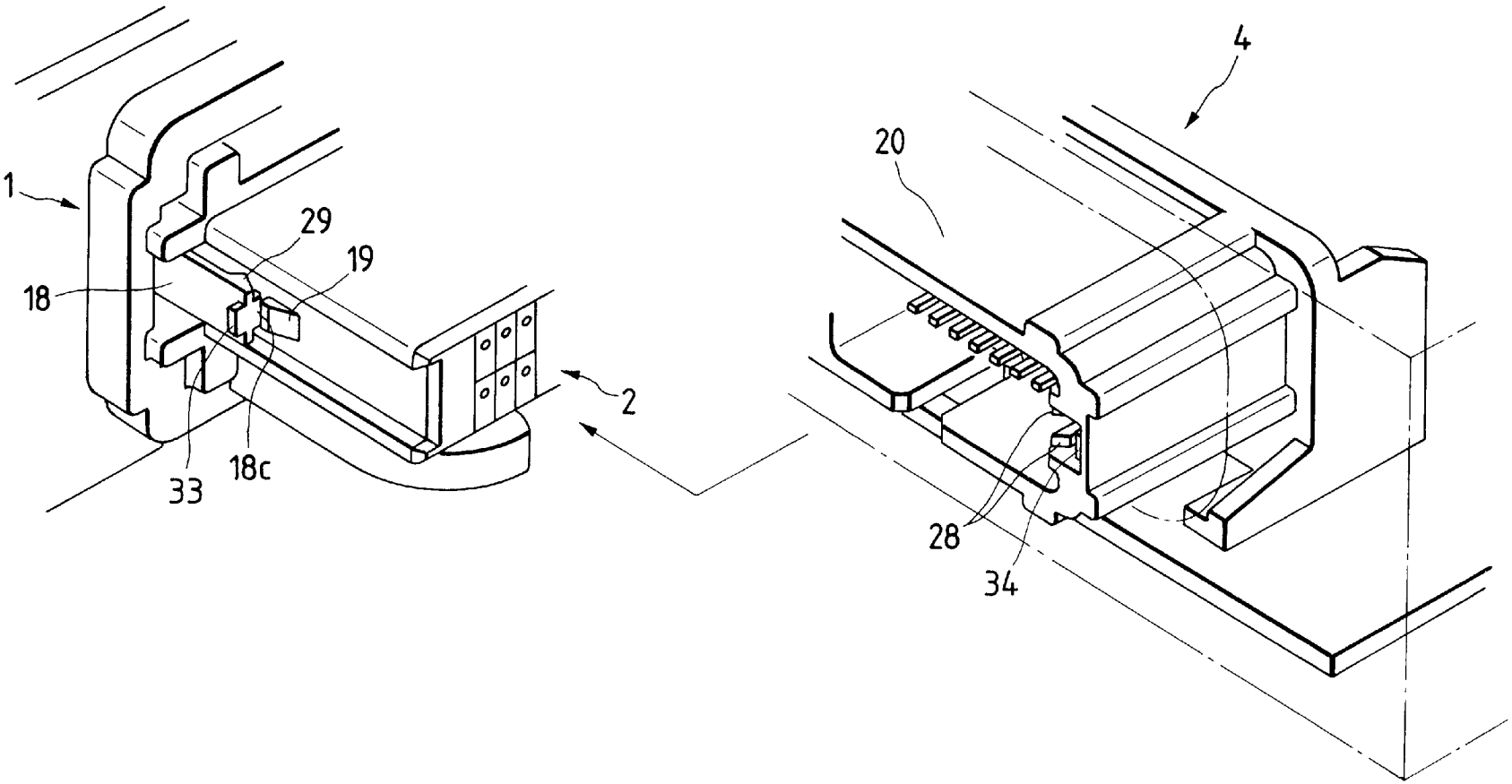
FIG. 20 is a perspective view showing a further embodiment of a connector connection construction of the invention.
Figure 21:
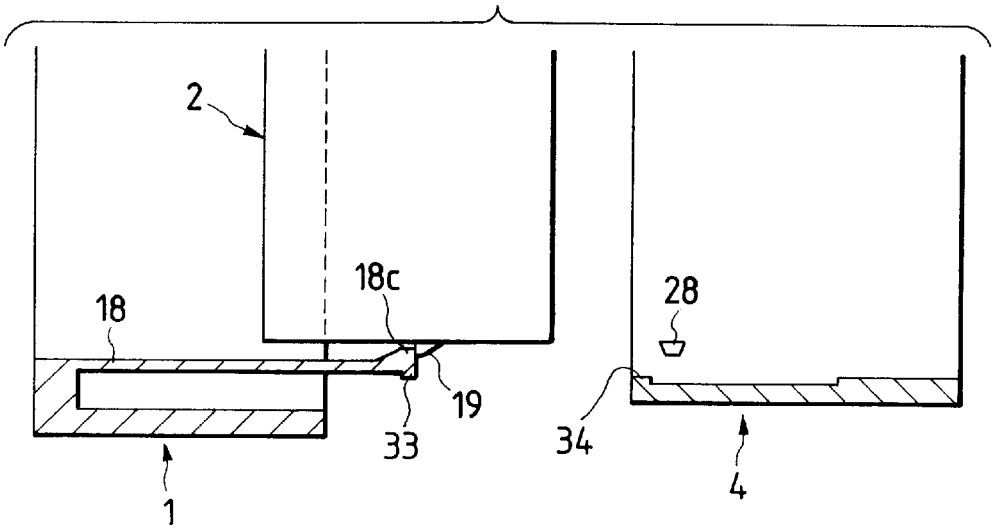
FIG. 21 is a cross-sectional view showing a condition before the connectors are connected together in the above embodiment.

As shown in FIGS. 20 and 21, preferably, a projection 33 is formed on an outer surface of the distal end of each provisionally-retaining portion 18 which is formed on the holder 1 for provisionally retaining the first connector 2 in the connection stand-by position, and projections 34, which can face the projections 33, respectively, are formed at the front end of the second connector 4. The projection 33 and projection 34 joint constitute a disengagement prevention mechanism by which the second connector 4 is prevented from being disengaged from the holder 1 until the first connector 2 is withdrawn into the connection stand-by position.

Figure 22:
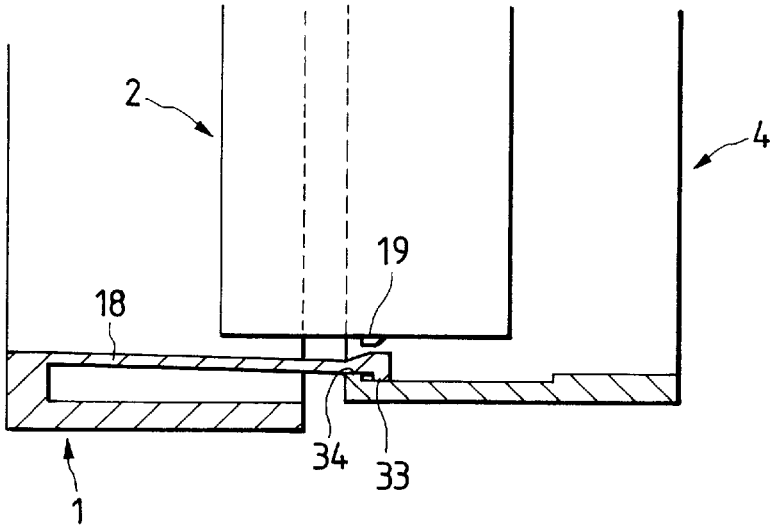
FIG. 22 is a cross-sectional view showing the process of a connector connection release operation in the above embodiment.

Namely, the amount of projecting of the projection 33 of the provisionally-retaining portion 18, as well as the amount of projecting of the projection 34 of the second connector 4, is so determined that normally, they will not interfere with each other, and when connecting the connectors together, the second connector 4 can be fitted on and connected to the first connector 2 without interference of the disengagement prevention mechanism. During the connector connection release process in which each projection 28 of the second connector 4 abuts against the projection 29 of the provisionally-retaining portion 18 to push the distal end portion of the provisionally-retaining portion 18 outwardly (that is, at the stage before the projection 19 of the first connector 2 slides past the projection 18*c* of the provisionally-retaining portion 18 as shown in FIG. 22), the projection 33 interferes with the projection 34, thereby preventing the disengagement of the second connector 4. And, at the time when the first connector 2 moves to the connection stand-by position, so that the pushed-condition of the provisionally-retaining portion 18 is released, the interference of the projection 33 with the projection 34 is released, so that the second connector 4 can be disengaged from the holder 1.

In the above construction, there are occasions when an external force is applied at the time of the connector connection release operation when the first connector 2 is withdrawn toward the front side of the holder 1 into the connection stand-by position by the withdrawal drive portions 30, and in such a case the disengagement prevention mechanism prevents the situation in which the second connector 4 is prevented from being disengaged, with the first connector 2 prevented from movement into the connection stand-by position. Therefore, the first connector 2 can be moved into the connection stand-by position by the withdrawal drive portions 30, and the swingable levers 5 can be set to their initial position where the opening portions 25*a* of the engagement grooves 25, formed respectively in the swingable levers 5, are opposed to the driven pins 23 formed on the second connector 4.

Figure 23:
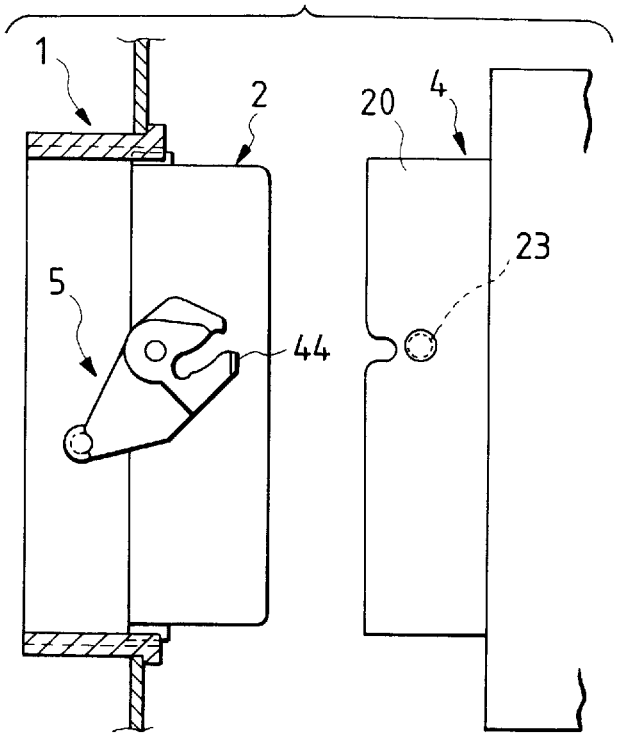
FIG. 23 is a cross-sectional view showing a further embodiment of a connector connection construction of the invention.
Figure 24:
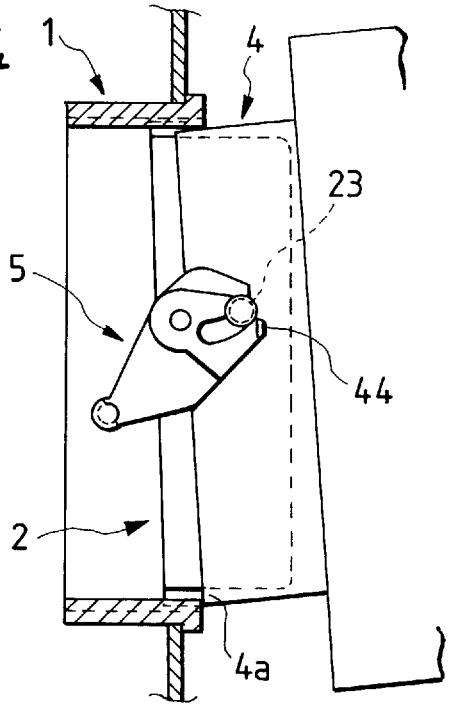
FIG. 24 is a cross-sectional view showing the process of a connector connection release operation in the above embodiment.

As shown in FIG. 23, there may be provided a construction in which a limitation portion 44 in the form of a projection is formed at the open end portion of the engagement groove 25 formed in the swingable lever 5, and during the connection release operation of releasing the connected condition of the first and second connectors 2 and 4, a flange or the like of the driven pin 23, formed on the connector housing 20 of the second connector 4, is abutted against the limitation portion 44, thereby applying a withdrawing resistance to the second connector 4. With this construction, even if the second connector 4 is withdrawn or pulled obliquely during the connection release operation as shown in FIG. 24, there can be effectively avoided a situation in which the connection between the first and second connectors 2 and 4 is released, with the first connector 2 kept inclined.

Namely, without the limitation portions 44, when the second connector 4 is pulled obliquely as described above, the withdrawing resistance to the second connector 4 is reduced at the time of disengagement of one end 4*a* of the second connector 4 from the holder 1, and therefore the first connector 2 is inevitably kept oblique, with the first and second connectors 2 and 4 disengaged from each other. On the other hand, when there are provided the limitation portions 44 for applying a withdrawing resistance to the second connector 4, the connected condition of the first and second connectors 2 and 4 is maintained by the limitation portions 44 (which are disposed centrally of the width of the second connector 4) even if the one end 4*a* of the second connector 4 is disengaged from the holder 1, and the pulling drive force can be exerted about the limitation portions 44 in a direction to correct the inclination of the first connector 2, and therefore the first connector 2 can be corrected into a suitable posture.

As described above, each guide groove 10 formed in the holder 1 has a retaining groove portion 10*c* at its rear end portion. The engagement pins 9, respectively in the retaining groove portions 10*c*, are moved directly rearward toward the back of holder 1. With this structure, the final stage of connection of the second connector 4 to the first connector 2 takes place without swinging displacement of the swingable levers 5. The first connector 2 and the second connector 4 are slidingly displaced in unison along the support portions of the holder 1.

Given the above configuration, even when a force tending to disconnect the first connector 2 and the second connectors 4 from each other is applied to move each engagement pin 9 in the associated guide groove 10C, the force will not swingingly displace the swingable levers 5. Consequently, the two connectors 2 and 4 are stably kept in the connected condition. Furthermore, within the range of the retaining groove portions 10*c*, the first connector 2, the second connector 4 and the engagement pins 9 move in unison back and forth relative to the holder 1, and therefore, even if there is a variation in the amount of pushing of the electronic unit 22, the two connectors 2 and 4 are shifted into the completely-connected condition.

Figure 25:
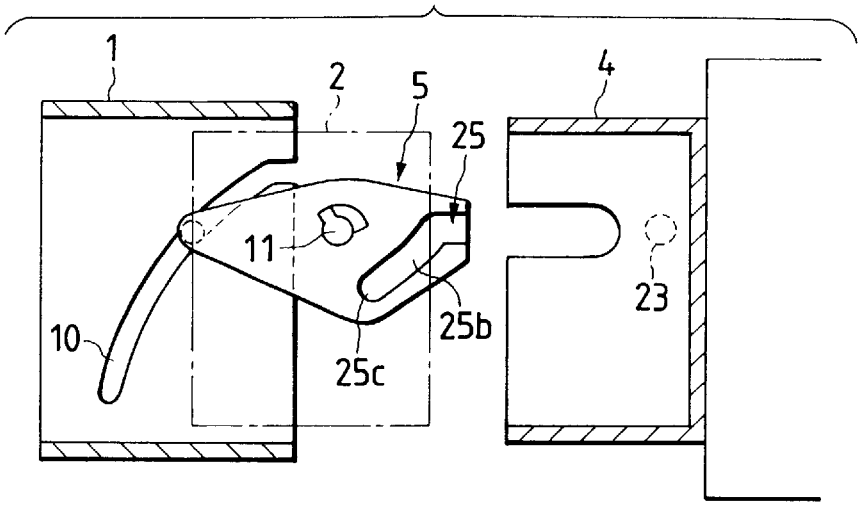
FIG. 25 is a cross-sectional view of a sixth preferred embodiment of a connector connection structure of the present invention.

The above structure comprises guide grooves 10 in the holder 1 which each have retaining groove portion 10*c*, which results in the first connector 2 and the second connector 4 being slidingly displaced in unison in the holder 1 during the final stage of connection. An alternative structure provides a retaining groove portion 25*c* of an arcuate shape, which is equidistant from the swing pivot 11 of the swingable lever 5 throughout its length and extends continuously from the operating groove portion 25*b* of the engagement groove 25, as shown in FIG. 25.

Figure 26A:
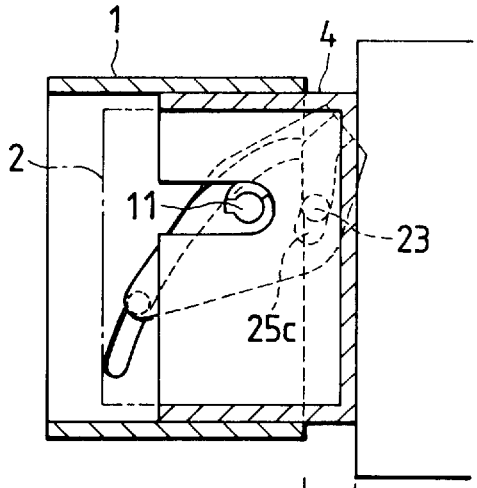
FIGS. 26A–B is a view showing the operation of the sixth preferred embodiment.
Figure 26B:
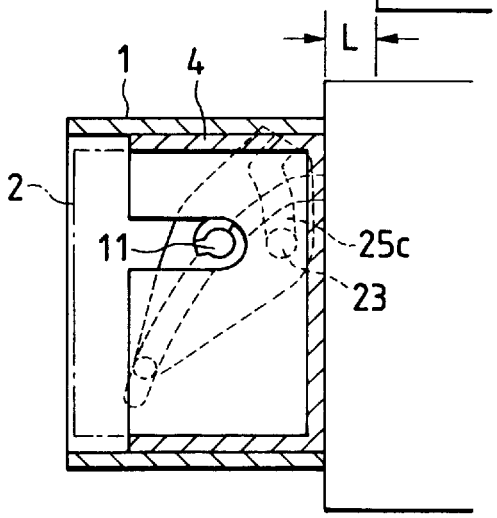

In this alternative structure, when the second connector 4 is to be connected to the first connector 2, the swingable levers 5 are swingingly displaced in response to the sliding movement of the second connector 4, and each driving pin 23, formed on the second connector 4, is introduced into the associated retaining groove portion 25*c* as shown in FIG. 26A. When each swingable lever 5 is further swingingly displaced, the first connector 2 and the second connector 4 are slidingly displaced in unison in the holder 1 since the distance between each driven pin 23 and the associated swing pivot 11 will not vary, as shown in FIG. 26B.

In this embodiment, a distance L designates the difference in the distance between a front surface of holder 1 and a rear surface of connector 4 when the holder 1 and connector 4 are in positions A and B. Position A (FIG. 26A) represents a position where the driving pin 23 is introduced into the retaining groove portion 25*b* of the engagement groove 25 and position B (FIG. 26B) represents a position where the driving pin 23 reaches the end of the retaining groove portion 25*b*. The distance L serves as "play" for the connection of the second connector 4 to the first connector 2. Consequently, even if the push position at the final stage of the connection of the second connector 4 to the first connector 2 is displaced forwardly or rearwardly within the range of the distance L because of an manufacturing error of the connectors or some other reason, the two connectors 2 and 4 are always shifted into the completely-connected condition.

Figure 27:
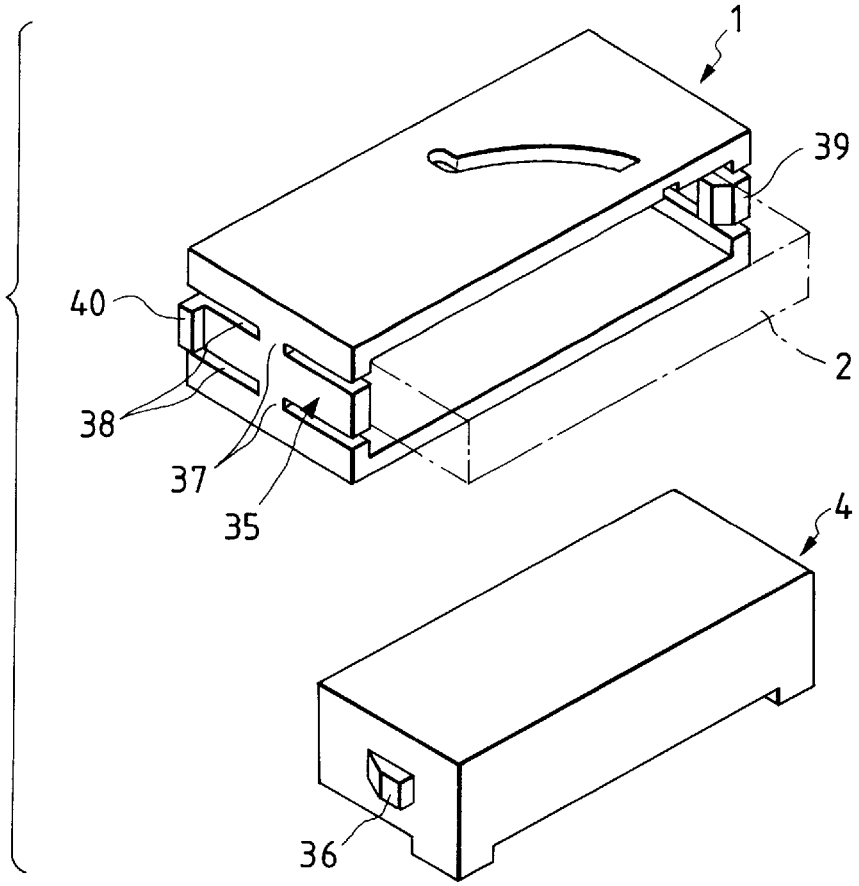
FIG. 27 is a perspective view showing a further embodiment of a connector connection construction of the invention.
Figure 28:
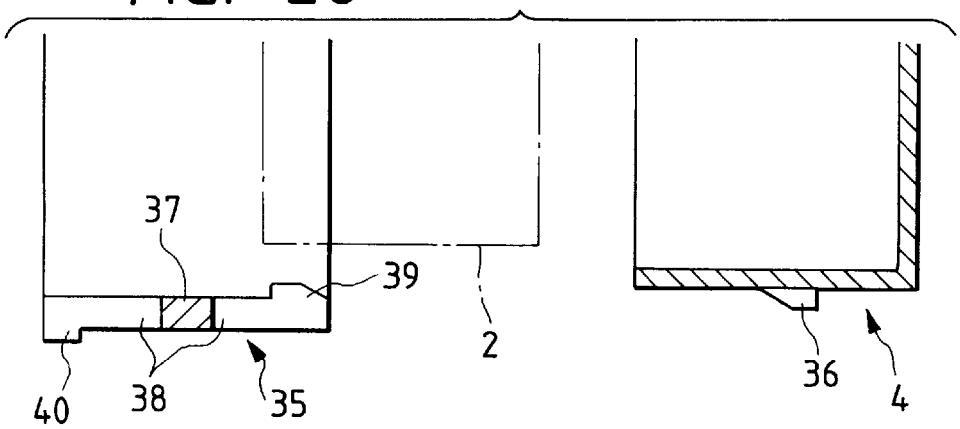
FIG. 28 is a cross-sectional view showing the process of connecting connectors together in the above embodiment.

As shown in FIGS. 27 and 28, there may be provided a lock mechanism which comprises a lock arm 35 formed at each of the opposite side walls of the holder 1, and an engagement projection 36 formed on each of the opposite side walls of the second connector 4. The lock arm 35 is separated from the side wall of the holder 1 by slits 38 interrupted at a connection portion 37 provided at a central portion of this side wall, and by deforming the connection portion 37 in a twisted manner, the lock arm 35 can be swung. A lock projection 36, which can be opposed to the engagement projection 35, is formed on an inner surface of the lock arm 35 at a front end thereof. A projection 40 for effecting the swinging operation is formed on an outer surface of the lock arm 35 at a rear end thereof. Slanting surfaces, which can face each other, are formed on the engagement projection 36 and the lock projection 39, respectively.

Figure 29:
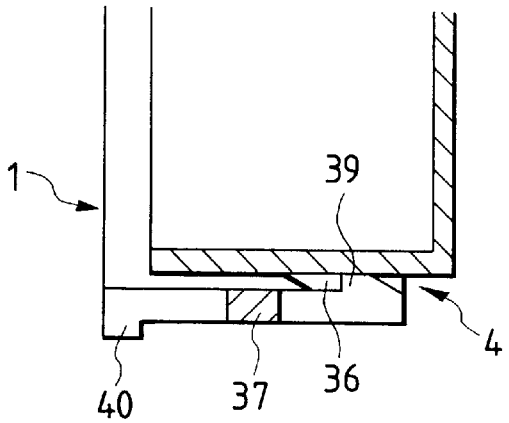
FIG. 29 is a cross-sectional view showing a condition in which the connectors are connected together in the above embodiment.

In the above construction, when the first connector 2, supported by the holder 1, is to be connected to the second connector 4, the lock projection 39 of the lock arm 35 is pressed or pushed by the engagement projection 36 of the second connector 4 to twistingly deform the connection portion 37, thereby swingingly displacing the lock arm 35, so that the engagement projection 36 can shift into a locked condition shown in FIG. 29. Therefore, in the connected condition of the two connectors 2 and 4, the lock mechanism prevents the second connector 4 from moving in the connection release direction, and even when an external force, tending to release the connection between the first and second connectors 2 and 4, is exerted, the connected condition of the two connectors 2 and 4 is positively maintained, and the disconnection of the two connectors 2 and 4 due to swinging displacement of the swingable lever 5 in a lock release direction is effectively prevented.

For releasing the connection between the first and second connectors 2 and 4, the swinging operation projection 40 is pressed inwardly to swingingly displace the lock arm 35 in a direction to release the engagement between the engagement projection 36 and the lock projection 39, and in this condition the second connector 4 is pulled rearwardly, so that the locking of the second connector 4 by the lock mechanism is released, and the second connector 4 is moved in the connection release direction, thereby disconnecting the second connector 4 from the first connector 2.

The lock arms 35 each having the lock projection 39 may be provided at the second connector 4 while the engagement projections 36 for engagement with the respective lock projections 39 may be provided on the holder 1. The projection 40 for swinging the lock arm 35 in the lock release direction does not always need to be provided, and the lock arm 35 may be swung in the lock release direction through the lock projection 39 or other portion, or the lock arm 35 may be swingingly displaced in accordance with the operating force to pull the first and second connectors 2 and 4 in the connection release direction.

Figure 30:
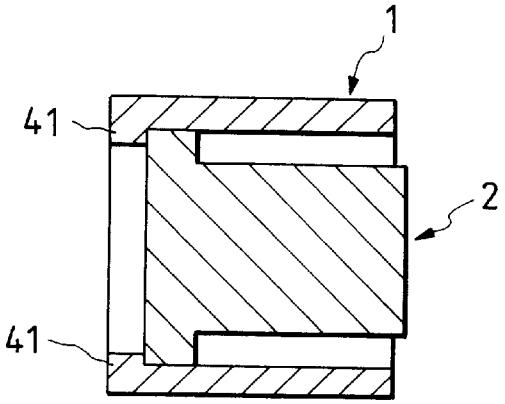
FIG. 30 is a cross-sectional view showing a further embodiment of a connector connection construction of the invention.

Preferably, in order to prevent the first connector 2 from being withdrawn from the holder 1, for example, when rearwardly pulling the terminals off the first connector 2 supported by the holder 1, retaining portions 41 are formed on the inner surface of the holder 1 at the rear end thereof as shown in FIG. 30, and the retaining portions 41 abut against the rear end surface of the first connector 2 to prevent the first connector 2 from being withdrawn rearwardly from the holder 1. With this construction, the terminals can be easily attached or removed without disengaging the first connector 2 from the holder 1, that is, with the first connector 2 retained adjacent to the rear side of the holder 1 by the retaining portions 41 of the holder 1.

Figure 31:
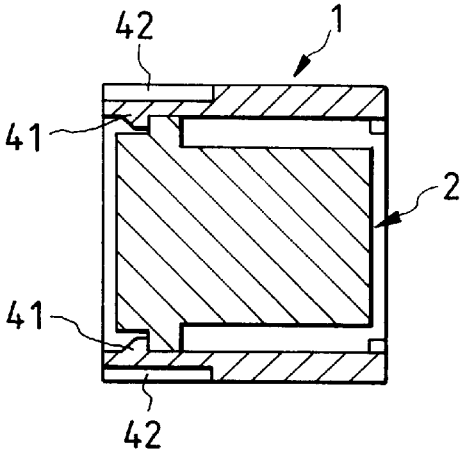
FIG. 31 is a cross-sectional view showing a further embodiment of a connector connection construction of the invention.

As shown in FIG. 31, there may be provided a construction in which thin, movable walls 42 are provided at the upper and bottom walls of the holder 1, and the above retaining portions 41 are formed respectively on the movable walls 42. In this construction, there is an advantage that the movable walls 42 are swingingly displaced when the first connector 1 is inserted into the holder 1 from the rear side of the holder 1, so that the first connector can be easily inserted into the holder 1.

Figure 32:
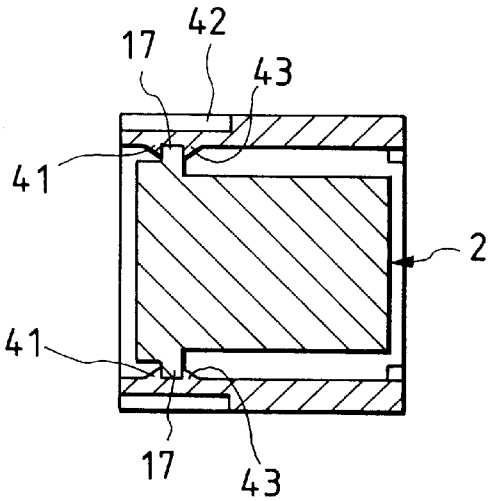
FIG. 32 is a cross-sectional view showing a further embodiment of a connector connection construction of the invention.

As shown in FIG. 32, there may be provided a construction in which a provisionally-retaining projection 43 is provided forwardly of the retaining portion 41 formed on each movable wall 42, and the provisionally-retaining projection 43 abuts against the front surface of the associated projection 17, formed at the rear portion of the first connector 2, to provisionally retain the first connector 2 at a position adjacent to the rear side of the holder 1. In this construction, there is an advantage that the terminals can be easily inserted, with the first holder 2 retained at the above provisionally-retaining position adjacent to the rear side of the holder 1.

Figure 33:
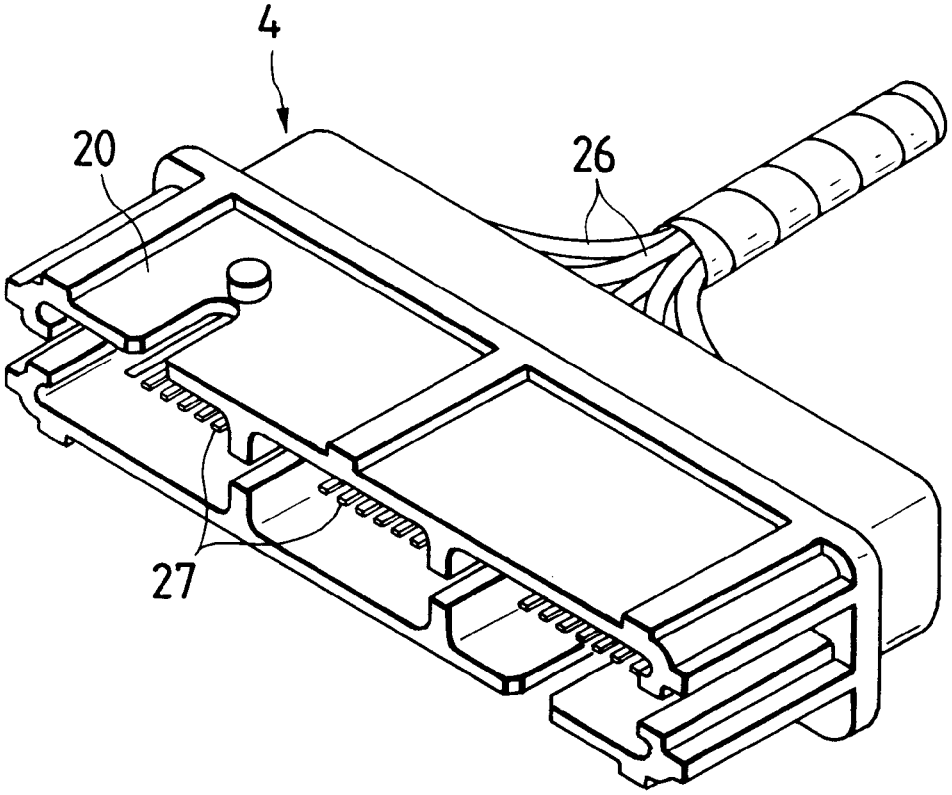
FIG. 33 is a perspective view of a modified second connector.

A further advantage of the present invention is that it is not always necessary to mount the second connector 4 (which is to be connected to the first connector 2 supported on the mounting portion S) on the circuit board 3 provided in the electronic unit 22. The second connector 4, comprising a male connector housing 20 and male terminals 27 connected at their rear ends to a harness 25 as shown in FIG. 33, may be connected directly to the first connector 2. Furthermore, the holder 1 and the first connector 2 do not always need to be supported on the mounting portion S. The holder 1 and the first connector 2, while held by the operator, may be connected directly to the second connector 4.

In the above embodiments, the first connector 2 is slidably supported by the holder 1 which is mounted on the mounting portion S of the vehicle body, while the second connector 4, to be connected to the first connector 2, is mounted on the electronic unit 22. Alternatively, the first connector 2 including the swingable levers 5, the female connector housing 14, and the holder 1 may be mounted on the electronic unit 22, and the second connector 4 including the male connector housing 20, may be mounted on the mounting portion S. In this case, the electronic unit 22 serves as the mounting portion for the first connector 2. Furthermore, the holder 1 which holds the first connector 2 may be integrally formed with a molding component such as a case of the electronic unit, a instrument panel of the vehicle, or a trim cover.

Instead of the above structure in which the engagement pins 9, formed respectively on the swingable levers 5, are introduced into and engaged in the respective guide grooves 10 formed in the holder 1, a structure is provided wherein the engagement pins 9 are formed on the holder 1, and the guide grooves 10, in which the engagement pins 9 are engageable, respectively, are formed in the swingable levers 5, respectively. The swingable levers 5 are swingably supported on the holder 1, and the drive groove portions 10*b*, forming the drive portions for swingingly displacing the swingable levers 5 and for receiving the engagement pins 9, and provided on the connector housing 14 of the first connector 2.

In the present invention, a holder has a support portion for supporting a first connector such that the first connector is slidable in the direction of connection of a first and a second connector relative to each other, swingable levers are swingingly displaced in response to the sliding movement of the first connector, and a driving force of the swingable levers is increased and transmitted to a portion of connection between the first and second connectors. By a one-touch operation for connecting the second connector to the first connector, a strong connecting force is exerted at the connecting portion between the two connectors. Therefore, the present invention is applicable even if a multi-pole connector, requiring a large connecting force, is mounted in a position inaccessible by the hand of an operator. In such a situation, the connection of the two connectors relative to each other is effected easily and positively in the present invention.

Further, a swingable lever is provided between the wall surface of the holder and the surface of the first connector opposed to this wall surface. Consequently, the swingable lever is prevented from projecting out of the connector-mounting range and advantageously prevents the formation of any dead space resulting therefrom. Also, the second connector is driven in the connecting direction by swingingly displacing the swingable lever.

Furthermore, the plurality of swingable levers are provided between the wall surface of the holder and the surface of the first connector disposed in opposed relation to the wall surface, and therefore when connecting the first and second connectors together, a uniform connecting force can be exerted at a plurality of portions in the direction of the width thereof, so that the two connectors can be connected together in a proper condition, and also there is an advantage that by reducing the thickness of the plate of the swingable lever, the overall size of the connector can be reduced.

Furthermore, a pair of swingable levers are provided in adjacent, facing relation to the opposed wall surfaces of the holder, respectively, and the swingable levers are disposed in a point-symmetrical manner. Therefore, in response to the sliding displacement of the first connector resulting from a drive force to connect the first and second connectors together, large connecting forces are exerted respectively at opposite side portions of the two connectors on the diagonal lines. With the present simple structure, uniform connecting forces are applied to opposite side portions of the two connectors, so that the two connectors are properly connected together.

Furthermore, at least one pair of opposed swingable levers are provided between the holder and the first connector, and the opposed swingable levers are swingable in opposite directions, respectively. Therefore, the widthwise components of the drive forces, transmitted respectively from the two swingable levers to the second connector, cancel each other, resulting in straight displacement of the second connector and proper connection to the first connector.

Furthermore, at least one pair of swingable levers of the same configuration are provided in adjacent, facing relation to the opposed wall surfaces of the holder. The opposed swingable levers are disposed in an inverted manner with respect to their opposite sides. Consequently, production of dissimilar parts is reduced, enhancing mass productivity. The opposed swingable levers are swingable in the opposite directions, respectively, so that the second connector is slidingly displaced in a straight motion.

Furthermore, a retaining portion for limiting forward withdrawal of the first connector is formed at the portion of connection between the holder and the first connector. The holder and the first connector are kept in a stably-connected condition, thereby effectively preventing the first connector from being disengaged from the holder.

Furthermore, a provisionally-retaining portion, for provisionally retaining the first connector in a connection stand-by position, is provided at the portion of connection between the holder and the first connector. The first connector is released by the provisionally-retaining portion when the operating force, which connects the first connector and the second connector together, overcomes the provisionally-retaining force. The present invention advantageously prevents the first connector from being pushed into the holder before the two connectors are connected. When the two connectors are to be connected together, the retaining condition, achieved by the provisionally-retaining portion, is released with one touch.

Furthermore, a provisional retaining-release portion, for urging the provisionally-retaining portion of the first connector into the provisional retaining-release position, is formed on the second connector. When the second connector is to be connected to the first connector, the provisionally-retained condition of the first connector is released by the provisional retaining-release portion. Consequently, the first connector is stably kept in a connection stand-by position until the two connectors are to be connected together. At that time, the provisional retaining force of the provisionally-retaining portion is easily overcome by a connection force.

Furthermore, a withdrawal drive portion is preferably provided between the first connector and the second connector. When the first connector and the second connector are to be disconnected from each other, the withdrawal drive portion slidingly displaces and withdraws the first connector into a connection stand-by position. By pulling the second connector to disconnect the two connectors from each other, the first connector is slidingly displaced toward the front side of the holder, and is automatically moved into the connection stand-by position.

Furthermore, there is provided the disengagement prevention mechanism for preventing the second connector from being disengaged from the holder during the connection release operation of releasing the connected condition of the first and second connectors, and the condition of disengagement prevention of the second connector by the disengagement prevention mechanism is released when the first connector is withdrawn into the connection stand-by position by the withdrawal drive portion. There are occasions when an external force is applied at the time of the connector connection release operation when the first connector is withdrawn toward the front side of the holder into the connection stand-by position by the withdrawal drive portions, and in such a case the disengagement prevention mechanism prevents the situation in which the second connector is prevented from being disengaged, with the first connector prevented from movement into the connection stand-by position, and the first connector can be positively moved into the connection stand-by position by the withdrawal drive portions. Therefore, when connecting the second connector again to the first connector, the swingable levers 5 can be set to their initial position so that the operation of connecting the two connectors together can be effected properly.

Furthermore, the limitation portion, which applies a withdrawing resistance to the second connector during the connection release operation of releasing the connected condition of the first and second connectors, is provided between the swingable lever and the operating portion therefor. Therefore, even if the second connector is pulled obliquely during the connector release operation, there can be effectively avoided a situation in which the connection between the first and second connectors is released, with the first connector-kept inclined.

Furthermore, the final stage of the connection of the second connector to the first connector corresponds to the two connectors being slidingly displaced in unison along the holder. Even if a force tending to disconnect the first and second connectors from each other is applied, the two connectors are kept in a stably connected condition. Furthermore, even if the connector-connecting position is somewhat varied, the two connectors are shifted into a completely-connected condition.

Furthermore, the lock mechanism for preventing the second connector, connected to the first connector, from moving in the connection release direction, is provided between the second connector and the holder. Therefore, in the connected condition of the first and second connectors, the lock mechanism prevents the second connector from moving in the connection release direction, and even when an external force, tending to release the connection between the first and second connectors, is exerted, the connected condition of the two connectors 2 and 4 is positively maintained, and the disconnection of the two connectors due to swinging displacement of the swingable lever in a lock release direction is effectively prevented.

Furthermore, the retaining portion for preventing the first connector, supported on the holder, from being withdrawn rearwardly, is provided at the portion of connection between the holder and the first connector. With this construction, when removing the terminals from the first connector, the retaining portion prevents the first connector from being withdrawn rearwardly from the holder, and therefore the removal of the terminals can be easily effected.

This invention has been described in detail with reference to preferred embodiments thereof, which are intended to be illustrative, but not limiting. Particularly, the present invention is applicable to many kinds of connectors such as a waterproof connector, a shield connector, a coaxial connector, a card edge connector, a press fitting connector, an optical connector, a charging connector, or a block connector. Various changes may be made without departing from the spirit and scope of the invention as set forth in the appended claims.

What is claimed is:

1. A connector connection structure comprising:

a first connector;

a second connector connectable to said first connector;

a holder having a support portion for supporting said first connector such that said first connector is slidable in a direction of connection of said second connector to said first connector;

at least one swingable lever swingably supported between said holder and said first connector and physically engageable therebetween;

a drive portion that swingingly displaces said swingable lever in response to a sliding movement of said first connector during connection of said second connector to said first connector; and an operating portion that increases a driving force of said swingable lever, and transmits said driving force to said second connector, thereby moving said second connector in a direction to connect said second connector to said first connector.

2. A connector connection structure according to claim 1, wherein said at least one swingable lever is provided between a wall surface of said holder and a surface of said first connector opposed to said wall surface.

3. A connector connection structure according to claim 1, wherein a plurality of swingable lever-are provided between a wall surface of said holder and a surface of said first connector opposed to said wall surface.

4. A connector connection structure according to claim 1, wherein said at least one swingable lever comprises at least two swingable levers facing opposite wall surfaces of said holder, respectively, said swingable levers being disposed in a symmetrical manner.

5. A connector connection structure according to claim 1, wherein said at least one swingable lever comprises at least two swingable levers, said at least two swingable levers forming at least one pair of swingable levers, said at least one pair of swingable levers being provided between said holder and said first connector facing opposite wall surfaces of said holder, said at least one pair of swingable levers being swingable in opposite directions, respectively.

6. A connector connection structure according to claim 1, wherein said at least one swingable lever comprises at least two swingable levers having the same configuration and facing opposite wall surfaces of said holder, respectively, said at least two swingable levers forming at least one pair of swingable levers, said at least one pair of swingable levers being disposed in an inverted manner on opposite sides of the first connector.

7. A connector connection structure according to claim 1, further comprising a provisionally-retaining portion for provisionally retaining said first connector in a connection stand-by position, said provisionally-retaining portion being formed on a portion of connection between said holder and said first connector.

8. A connector connection structure according to claim 1, wherein said first connector and said second connector are slidingly displaced in unison along said holder to complete connection of the connectors.

9. A connector connection construction according to claim 1, wherein a lock mechanism for preventing said second connector, connected to said first connector, from moving in a connection release direction, is provided between said second connector and said holder.

10. A connector connection construction according to claim 1, wherein a retaining portion for preventing said first connector, supported on said holder, from being withdrawn rearwardly, is provided at a portion of connection between said holder and said first connector.

11. A connector connection structure according to claim 1, further comprising a retaining portion for limiting forward withdrawal of said first connector, said retaining portion being formed on a portion of connection between said holder and said first connector.

12. A connector connection structure according to claim 11, further comprising a provisional retaining-release portion for urging the provisionally-retaining portion of said first connector into a provisional retaining-release position, said provisional retaining-release portion being formed on said second connector.

13. A connector connection structure according to claim 1, further comprising a withdrawal drive portion provided between said first connector and said second connector, said withdrawal drive portion being structured to slidingly displace said first connector to withdraw said first connector into a connection stand-by position.

14. A connector connection construction according to claim 13, wherein there is provided a disengagement prevention mechanism for preventing said second connector from being disengaged from said holder during the connection release operation of releasing the connected condition of said first and second connectors, and the condition of disengagement prevention of said second connector by said disengagement prevention mechanism is released when said first connector is withdrawn into the connection stand-by position by said withdrawal drive portion.

15. A connector connection construction according to claim 13, wherein a limitation portion, which applies a withdrawing resistance to said second connector during the connection release operation of releasing the connected condition of said first and second connectors, is provided between said swingable lever and the operating portion therefor.

16. A connector connection structure comprising:

a holder;

a first connector;

a second connector; and means for positively connecting said first and second connectors using a single unidirectional connection force to form a complete connection, said means for positively connecting including a swingable lever swingably supported between and physically engaged with said holder and said first connector, said first connector at least partially disposed in said holder to allow movement therebetween, said connection being accomplished without requiring hand adjustments to said swingable lever by an operator.

* * * * *